US008717395B2

(12) United States Patent
Marcus et al.

(10) Patent No.: US 8,717,395 B2
(45) Date of Patent: May 6, 2014

(54) LARGE-PARTICLE INKJET RECEIVER-CHARGING INTERMEDIATE MEMBER

(75) Inventors: Michael Alan Marcus, Honeoye Falls, NY (US); Hrishikesh V. Panchawagh, San Jose, CA (US)

(73) Assignee: Eastman Kodak Company, Rochester, NY (US)

( * ) Notice: Subject to any disclaimer, the term of this patent is extended or adjusted under 35 U.S.C. 154(b) by 42 days.

(21) Appl. No.: 13/547,473

(22) Filed: Jul. 12, 2012

(65) Prior Publication Data

US 2014/0015880 A1 Jan. 16, 2014

(51) Int. Cl.
*B41J 2/41* (2006.01)

(52) U.S. Cl.
USPC ..... 347/112; 347/103; 347/154

(58) Field of Classification Search
None
See application file for complete search history.

(56) References Cited

U.S. PATENT DOCUMENTS

| | | | |
|---|---|---|---|
| 4,943,816 | A | 7/1990 | Sporer |
| 5,847,721 | A | 12/1998 | Ogata et al. |
| 6,702,425 | B1 | 3/2004 | Yip et al. |
| 7,232,214 | B2 | 6/2007 | Yip et al. |

*Primary Examiner* — Justin Seo
(74) *Attorney, Agent, or Firm* — Christopher J. White; Peyton C. Watkins

(57) ABSTRACT

Apparatus for producing a print on a recording medium includes a printhead providing drops of hydrophilic liquid. A hydrophobic drop-retention layer of an intermediate member receives the drops in cells including ion donors, forming a liquid pattern corresponding to image data. The ion donor in liquid-containing cells dissolves into ions. A transport member brings the recording medium into contact with the liquid pattern on the intermediate member. A voltage source applies a bias across the recording medium in contact with the liquid pattern to move ions to form a charge pattern corresponding to the liquid pattern on the recording medium. A development station applies charged dry ink to the recording medium bearing the charge pattern, so that a dry ink image corresponding to the image data is formed on the recording medium.

12 Claims, 16 Drawing Sheets

LARGE-PARTICLE INKJET RECEIVER-CHARGING INTERMEDIATE MEMBER

CROSS-REFERENCE TO RELATED APPLICATIONS

Reference is made to commonly assigned, U.S. patent application Ser. No. 13/547,152 filed Jul. 12, 2012, entitled "Large-Particle Inkjet Discharged-Area Development Printing," by Michael Marcus, et al.; U.S. patent application Ser. No. 13/547,279 filed Jul. 12, 2012, entitled "Large-Particle Inkjet Discharged-Area Development Printing," by Michael Marcus, et al.; U.S. patent application Ser. No. 13/547,320 filed Jul. 12, 2012, entitled "Large-Particle Inkjet Dual-Sign Development Printing," by Michael Marcus, et al.; U.S. Patent Application Serial Number, entitled "Intermediate Member For Large-Particle Inkjet Development," by Michael Marcus, et al., the disclosures of which are incorporated herein.

FIELD OF THE INVENTION

This invention pertains to the field of digitally controlled printing systems.

BACKGROUND OF THE INVENTION

Printers are useful for producing printed images of a wide range of types. Printers print on receivers (or "imaging substrates" or "recording media"), such as pieces or sheets of paper or other planar media, glass, fabric, metal, or other objects. Examples of such media include fabrics, uncoated papers such as bond papers, semi-absorbent papers such as clay coated papers commonly used in lithographic printing (e.g., Potlatch Vintage Gloss, Potlatch Vintage Velvet, Warren Offset Enamel, and Kromekote papers), and non-absorbent papers such as polymer-coated papers used for photographic printing.

Printers typically operate using subtractive color: a substantially reflective recording medium is overcoated imagewise with cyan (C), magenta (M), yellow (Y), black (K), and other colorants. Various schemes can be used to print images. For example, inkjet printing deposits drops of liquid ink in appropriate locations on a recording medium to form an image. However, inkjet printing is limited in the density it can produce.

U.S. Pat. No. 4,943,816 to Sporer discloses the use of a marking fluid containing no dye so that a latent image in the form of fluid drops is formed on a piece of paper. The marking fluid is relatively non-wetting to the paper. Sporer teaches the use of a 300 dpi thermal inkjet printer to produce the latent image. Surface tension then causes colored powder to adhere to the fluid drops. Sporer teaches that only that portion of the droplet that has not penetrated or feathered into the paper is available for attracting dry ink, so this process is unsuitable for highly-absorbent papers such as newsprint. Because of the limitations taught by Sporer of using thermal drop-on-demand and the limitation of 300 dpi, this process is only suitable for low volume, low speed printing applications requiring only modest image quality. There is therefore a continuing need for a way of producing high-quality images at high speed using inkjet printers.

SUMMARY OF THE INVENTION

Several problems with inkjet inks have been identified. First, lithographic inks conventionally used for high-quality, high-volume printing are highly viscous and contain a high concentration of pigment. In contrast, inkjet inks have low viscosity in order to be able to be jetted from an inkjet nozzle or head. Typical inkjet inks contain at most 10% solid colorants. Since inkjet inks penetrate into the paper and have low colorant concentrations, such prints often suffer from low image density. In contrast, images printed by lithographic (litho) and electrophotographic (EP) processes have high density, and correspondingly higher image quality. In litho and EP printers, the ink, colorant, or marking particulate matter resides on the surface of the paper, thereby blocking light from reaching the paper fibers. Prior schemes using purpose-made coated inkjet papers to attempt to improve image density are limited in the type of paper that can be used, and coated inkjet papers are generally more expensive than standard commercial papers.

Furthermore, typical aqueous- or solvent-based-inkjet droplets have volumes between approximately 2 and 10 pL, corresponding to spherical-droplet diameters of approximately 16 μm and 27 μm, respectively. Upon striking a non-absorbent receiver, the droplets can spread by between 1.5× and 3× (e.g., as described in U.S. Pat. No. 6,702,425, which is incorporated herein by reference). This results in spot sizes of between 24 μm and 81 μm, substantially larger than a 5-9 μm-diameter dry ink particle. In some systems, droplets can spread by 15× (as described in U.S. Pat. No. 7,232,214, which is incorporated herein by reference), resulting in spot sizes between 30 μm and 150 μm. The large size of the ink droplet limits resolution and can produce image artifacts such as granularity and mottle. (Small-drop-spread systems can also produce low-quality images because of the relatively lower proportion of the paper that is covered, e.g., as described in U.S. Pat. No. 5,847,721, which is incorporated herein by reference.)

Finally, despite large drop sizes, higher loadings of colorant or larger pigment particles cannot be used without compromising the jetting performance of the inkjet printer. These limitations on ink composition prevent aqueous inkjet systems from producing glossy or raised-letter prints (which are examples of "special-effects" prints) that EP printers are capable of producing. Although ultraviolet (UV)-curable inks can provide some effects, they have much higher viscosity than aqueous inks. Moreover, UV-curable inks require special handling to ensure that they are not exposed to ultraviolet light (e.g., from the sun) before they are printed. UV-curable inks are also not suited for as wide a range of substrates as aqueous inks.

The present invention provides a large-particle inkjet system that provides the high speed of inkjet printing and the high image quality and special-effects capability of EP printing. Various aspects of large-particle inkjet use liquid ink and dry ink together to produce images or special-effects prints. Large-particle inkjet is different from conventional dye-based inkjet or the clear-ink inkjet of U.S. Pat. No. 4,943,816 because those known systems use colorant on the molecular scale (dyes or pigments), not on the particle scale (micron-sized). Moreover, large-particle inkjet is different from conventional pigment-based inkjet because the dry ink particles used in large-particle inkjet, e.g., 4-8 μm in diameter, are much larger than the pigment particles suspended in the inkjet inks, e.g., 0.1 μm in diameter.

According to an aspect of the present invention, therefore, there is provided apparatus for producing a print on a recording medium, comprising:

a) a printhead adapted to provide drops of hydrophilic liquid;

b) an intermediate member having a conductive element and a drop-retention layer disposed over the conductive element, the drop-retention layer adapted to receive the drops of hydrophilic liquid, the drop-retention layer being formed from a hydrophobic material having a plurality of cells and including an ion donor disposed in one or more of the cells;

c) a controller adapted to receive image data for the print and control the printhead and the intermediate member so that a liquid pattern corresponding to the image data is produced in one or more of the cells of the intermediate member, wherein the ion donor in those cells dissolves in the deposited liquid so that the liquid pattern includes ions having respective signs of charge;

d) a transport member adapted to bring the recording medium into contact with the liquid pattern on the intermediate member;

e) a backing electrode arranged opposite the positioned recording medium from the intermediate member;

f) a voltage source adapted to apply a bias across the recording medium in contact with the liquid pattern using the backing electrode and the conductive element of the intermediate member, so that at least some of the ions of a selected one of the signs of charge move from the liquid pattern to the recording medium and a charge pattern corresponding to the liquid pattern is developed on the recording medium; and g) a development station adapted to apply charged dry ink to the recording medium bearing the charge pattern, so that a dry ink image corresponding to the image data is formed on the recording medium.

An advantage of this invention is that larger particles can be deposited than is possible with small-drop inkjet printers, providing improved image quality (e.g., density and durability) and enhanced special-effects capability. Large particles can be printed without requiring an EP photoreceptor and the associated cleaning and transfer hardware. Various aspects permit selective glossing or raised-letter printing using inkjet technology on conventional papers. In aspects using dry ink particles with a thermoplastic polymer binder, the dry ink particles can be deinked using conventional deinking solvents. This permits digital printing of images having the high quality, print density, and durability of an electrophotographic print without the costs associated with exposure, photoreceptor, and dry ink transfer systems. Since an EP primary imaging member is not used, the cost of a printer can be reduced and its reliability can be improved.

In various aspects, using small drops, higher resolution can be provided than in prior systems. For example, a 600 dpi (~23.6 dpmm) EP printer produces dots of approximately 42 μm diameter using, e.g., 5 μm-mean-diameter toner particles. As discussed above, a 24 μm inkjet dot can be printed. If dry ink is adhered to a dot of charged fluid of this size, the result is a print at an isolated-drop resolution of approximately 1,058 dpi (~41.7 dpmm). The larger size and higher density of dry ink particles permits this high-resolution print to be made and still retain desirable maximum density and edge sharpness.

In other aspects, the print resolution is determined by nozzle spacing and the number of offset nozzles. For example, two parallel 600 dpi nozzle arrays can be used, offset along their length axis by 1/1200" to provide 1200 dpi resolution. Additional nozzle arrays can be added much more simply than can additional EP photoreceptors, so various aspects described herein can achieve higher print resolutions than prior EP printers.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

Figure 1:
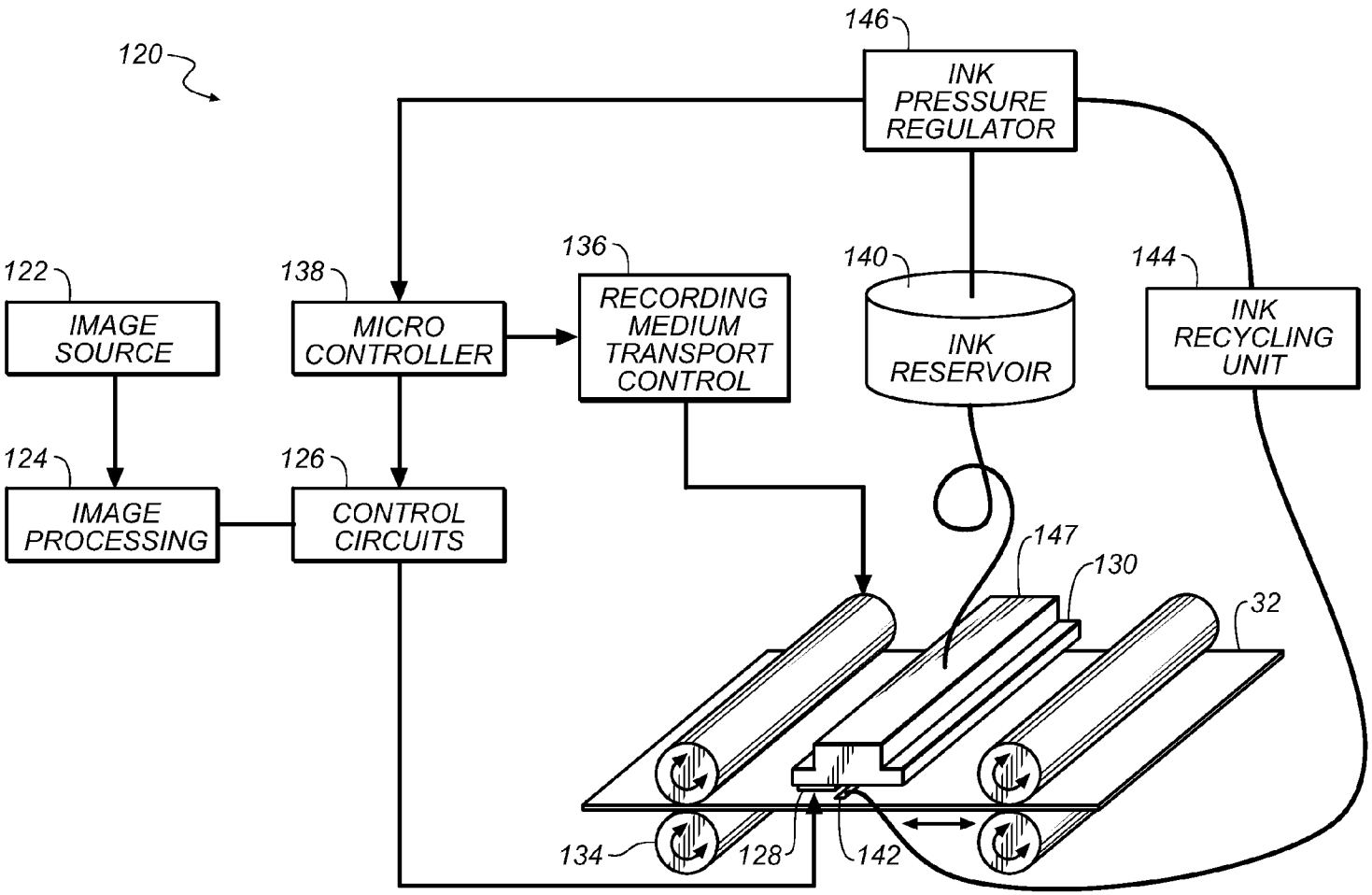
FIG. 1 is a schematic diagram of a continuous-inkjet printing system.

The attached drawings are for purposes of illustration and are not necessarily to scale.

DETAILED DESCRIPTION OF THE INVENTION

Reference is made to commonly assigned, co-pending U.S. patent application Ser. No. 13/245,947, filed Sep. 27, 2011, entitled "INKJET PRINTER USING LARGE PARTICLES," by Thomas N. Tombs, et al.; Ser. No. 13/245,971, filed Sep. 27, 2011, entitled "ELECTROGRAPHIC PRINTING USING FLUIDIC CHARGE DISSIPATION," by Thomas N. Tombs, et al.; Ser. No. 13/245,957, filed Sep. 27, 2011, entitled "LARGE-PARTICLE INKJET PRINTING ON SEMIPOROUS PAPER," by Thomas N. Tombs, et al.; Ser.

No. 13/245,977, filed Sep. 27, 2011, filed, entitled "ELECTROGRAPHIC PRINTER USING FLUIDIC CHARGE DISSIPATION," by Thomas N. Tombs, et al.; Ser. No. 13/245,964, filed Sep. 27, 2011, entitled "LARGE-PARTICLE SEMIPOROUS-PAPER INKJET PRINTER," by Thomas N. Tombs, et al.; U.S. patent application Ser. No. 13/077,496, filed Mar. 31, 2011, entitled "DUAL TONER PRINTING WITH DISCHARGE AREA DEVELOPMENT," by William Y. Fowlkes, et al.; and Ser. No. 13/245,931, filed Sep. 27, 2011, entitled "INKJET PRINTING USING LARGE PARTICLES," by Thomas N. Tombs, et al.; the disclosures of which are incorporated by reference herein.

The electrophotographic (EP) printing process and other printing processes, e.g., inkjet, electrostatographic, ionographic, or electrographic, can be embodied in devices including printers, copiers, scanners, and facsimiles, and analog or digital devices, all of which are referred to herein as "printers."

A digital reproduction printing system ("printer") typically includes a digital front-end processor (DFE), a print engine (also referred to in the art as a "marking engine") for applying dry ink to the recording medium, and one or more post-printing finishing system(s) (e.g. a UV coating system, a glosser system, or a laminator system). A printer can reproduce pleasing black-and-white or color onto a recording medium. A printer can also produce selected patterns of dry ink on a recording medium, which patterns (e.g. surface textures) do not correspond directly to a visible image. The DFE receives input electronic files (such as Postscript command files) composed of images from other input devices (e.g., a scanner, a digital camera). The DFE can include various function processors, e.g. a raster image processor (RIP), image positioning processor, image manipulation processor, color processor, or image storage processor. The DFE rasterizes input electronic files into image bitmaps for the print engine to print. In some aspects, the DFE permits a human operator to set up parameters such as layout, font, color, media type, or post-finishing options. The print engine takes the rasterized image bitmap from the DFE and renders the bitmap into a form that can control the printing process from the exposure device to transferring the print image onto the recording medium. The finishing system applies features such as protection, glossing, or binding to the prints. The finishing system can be implemented as an integral component of a printer, or as a separate machine through which prints are fed after they are printed.

The printer can also include a color management system which captures the characteristics of the image printing process implemented in the print engine (e.g. the electrophotographic process) to provide known, consistent color reproduction characteristics. The color management system can also provide known color reproduction for different inputs (e.g. digital camera images or film images).

As used herein, the term "paper" refers to a material that is generally made by pressing together moist fibers or weaving fibers. Papers include fibers derived from cellulose pulp derived from wood, rags, or grasses and drying them into flexible sheets or rolls. Paper generally contains moisture which remains after drying or is absorbed from exposure to air. Therefore, the term "paper" used herein includes conventional materials sold as paper and other materials, such as canvas, that possess corresponding characteristics.

As used herein, oliophilic and hydrophobic liquids are defined as organic liquids that are either immiscible or only slightly miscible with water. These include aliphatic and aromatic hydrocarbons. Hydrophilic and oliophobic liquids are defined as liquids that are wholly or substantially miscible with water. These include water-based solutions and suspensions such as inkjet inks containing pigments or dyes, water-based solutions, and low carbon alcohols, i.e. alcohols containing four or fewer carbons. Such alcohols include methanol, ethanol, propanol, butanol, isopropanol, isobutanol, and glycol. It should be noted that not all components of a hydrophilic liquid are necessarily soluble in water. For example, certain inkjet inks contain less than 10% (and generally less than 5%) pigment particles that are not soluble in water. Even though the pigment particles are not soluble in water, the inkjet ink is a hydrophilic liquid.

Inkjet inks contain a solvent or dispersant that either dissolves or disperses colorant. As used herein, "solvent" refers to this solvent or dispersant. Colorant can be in particulate form such as pigment particles. Alternatively, the colorant can be a dye that is either dissolved or dispersed in the solvent. Inkjet inks can also contain other components such as surfactants, dispersants that impart electrical charge to pigment particles to create a stable suspension, humectants, and fungicides. Oliophilic solvent-based inkjet inks are known, but most inkjet inks use hydrophilic solvents such as water or a low-carbon-containing alcohol.

Some dry ink particles do not contain macroscopic voids or pores, i.e., they are not porous. Porous dry ink particles can also be used. The surface-area-to-mass ratio of dry ink particles can be determined using the "BET" technique (devised by Brunauer, Emmett, and Teller). In this technique, nitrogen gas is absorbed onto a surface of a known mass of the dry ink particles. A solid, nonporous dry ink with particle sizes in the range of 5 μm to 9 μm can have a surface area of approximately 2 $m^2/g$. The addition of sub-micrometer particulate addenda can increase the surface area of the dry ink particles. For example, adding 3% by weight silica can increase the surface area to approximately 4 $m^2/g$. Porous particles can be classified as either open- or closed-cell. For a closed-cell porous dry ink, the majority of voids are separated from each other by the polymer binder of the dry ink. In an open-cell porous dry ink, the majority of voids are interconnected. The presence of interconnectivity can be determined by microtoming porous dry ink particles and examining the cellular structure in a transmission electron microscope (TEM). Alternatively, BET can be used to determine whether a porous dry ink has an open- or closed-cell structure. The surface area per unit mass of a porous dry ink is greater than that of a nonporous dry ink because the porous dry ink is less dense. Thus, the density of a porous dry ink is determined by measuring the volume of a known mass of dry ink and comparing that to the volume of an equivalent mass of nonporous dry ink of comparable size and similar polymer binder material. The surface area per unit mass is then measured using BET. For a closed-cell porous dry ink, the surface area per unit mass is approximately the same as that of the nonporous dry ink times the ratio of the mass densities of the nonporous and porous dry inks. Thus, a closed-cell porous dry ink with voids occupying half the dry ink would have a mass density of half of a comparable nonporous dry ink, and a corresponding surface area per unit mass twice that of the nonporous dry ink. If the surface area per unit mass measured by BET exceeds that predicted from the density measurements by a factor of at least two, the dry ink is considered an open-cell porous dry ink.

Dry inks used in EP printing can include dry particles containing a polymeric binder such as polyester or polystyrene. Dry ink can include charge agents to impart a specific dry ink charge or colorants. Moreover, sub-micrometer particulate addenda particles, such as various forms of hydrophobic silica, titanium dioxide, and strontium titanate, can be disposed on the surface of the dry ink to further control dry ink charge, enhance flow, and decrease adhesion and cohesion. Dry ink particles can include a colorant. The colorant can be a pigment or a dye. Present day dry ink particles have a diameter between approximately 5 μm and 9 μm and are made either by grinding or by chemical processes such as evaporative limited coalescence (ELC). For purposes of this disclosure, unless otherwise specified, the terms "dry ink diameter" and "dry ink size" refer to the volume weighted median particle diameter, as measured using a commercial device such as a Coulter Multisizer.

In the following description, some aspects of the present invention will be described in terms that would ordinarily be implemented as software programs. Those skilled in the art will readily recognize that the equivalent of such software can also be constructed in hardware. Because image manipulation algorithms and systems are well known, the present description will be directed in particular to algorithms and systems forming part of, or cooperating more directly with, methods described herein. Other aspects of such algorithms and systems, and hardware or software for producing and otherwise processing the image signals involved therewith, not specifically shown or described herein, are selected from such systems, algorithms, components, and elements known in the art. Given the system as described according to the invention in the following, software not specifically shown, suggested, or described herein that is useful for implementation of aspects herein is conventional and within the ordinary skill in such arts.

A computer program product can include one or more storage media, for example; magnetic storage media such as magnetic disk (such as a floppy disk) or magnetic tape; optical storage media such as optical disk, optical tape, or machine readable bar code; solid-state electronic storage devices such as random access memory (RAM), or read-only memory (ROM); or any other physical device or media employed to store a computer program having instructions for controlling one or more computers to practice methods described herein.

In continuous inkjet printing, a pressurized ink source is used to eject a filament of fluid through a nozzle bore from which ink drops are continually formed using a drop forming device. The ink drops are directed to a desired location using electrostatic deflection, heat deflection, gas-flow deflection, or other deflection techniques. "Deflection" refers to a change in the direction of motion of a given drop. For simplicity, drops will be described herein as either undeflected or deflected. However, these are not absolute terms: "undeflected" drops can be deflected by a certain amount, and "deflected" drops deflected by more than the certain amount. Alternatively, "deflected" and "undeflected" drops can be deflected in opposite directions. As described herein, the terms "liquid" and "ink" refer to any material that can be ejected by an inkjet printhead or inkjet printhead component described herein.

In various aspects, to print in an area of a recording medium or receiver, undeflected ink drops are permitted to strike the recording medium. To provide unprinted areas of the recording medium, drops which would land in that area if undeflected are instead deflected into an ink capturing mechanism such as a catcher, interceptor, or gutter. These captured drops can be discarded or returned to the ink source for re-use. In other aspects, deflected ink drops strike the recording medium to print, and undeflected ink drops are collected in the ink capturing mechanism to provide non-printing areas.

FIG. 1 is a schematic diagram of a continuous-inkjet printing system. Continuous printing system 120 includes image source 122, e.g., a scanner or computer, that provides raster image data, outline image data in the form of a page description language, or other forms of digital image data. This image data is converted to halftoned bitmap image data and stored in memory by image processing unit 124. A plurality of drop forming mechanism control circuits 126 read data from the image memory and apply time-varying electrical pulses to one or more drop forming device(s) 128, each associated with one or more nozzles of a printhead 130. These pulses are applied at an appropriate time, and to the appropriate nozzle, so that drops formed from a continuous inkjet stream will form spots on a recording medium 32 in the appropriate positions designated by the data in the image memory.

Recording medium 32 is moved relative to printhead 130 by a recording medium transport system 134, which is electronically controlled by a recording medium transport control system 136, which in turn is controlled by a micro-controller 138. Micro-controller 138 controls the timing of control circuits 126 and recording medium transport control system 136 so that drops land at the desired locations on recording medium 32. Micro-controller 138 can be implemented using an MCU, FPGA, PLD, PLA, PAL, CPU, or other digital stored-program or stored-logic control element. The recording medium transport system 134 shown in FIG. 1 is a schematic only, and many different mechanical configurations are possible. For example, a transfer roller can be used in recording medium transport system 134 to facilitate transfer of the ink drops to recording medium 32. With page-width printheads, recording medium 32 can be moved past a stationary printhead. With scanning print systems, the printhead can be moved along one axis (the sub-scanning or fast-scan direction), and the recording medium can be moved along an orthogonal axis (the main scanning or slow-scan direction) in a relative raster motion.

Ink is contained in ink reservoir 140 under pressure. In the non-printing state, continuous inkjet drop streams are not permitted to reach recording medium 32. Instead, they are caught in ink catcher 142, which can return a portion of the ink to ink recycling unit 144. Ink recycling unit 144 reconditions the ink and feeds it back to reservoir 140. Ink recycling units can include filters. A preferred ink pressure for a given printer can be selected based on the geometry and thermal properties of the nozzles and the thermal properties of the ink. Ink pressure regulator 146 controls the pressure of ink applied to ink reservoir 140 to maintain ink pressure within a desired range. Alternatively, ink reservoir 140 can be left unpressurized (gauge pressure approximately zero, so air in ink reservoir 140 is at approximately 1 atm of pressure), or can be placed under a negative gauge pressure (vacuum). In these aspects, a pump (not shown) delivers ink from ink reservoir 140 under pressure to the printhead 130. Ink pressure regulator 146 can include an ink pump control system.

The ink is distributed to printhead 130 through an ink manifold 147. Ink manifold 147 can include one or more ink channels or ports. Ink flows through slots or holes etched through a silicon substrate of printhead 130 to the front surface of printhead 130, where a plurality of nozzles and drop forming mechanisms, for example, heaters, are situated. When printhead 130 is fabricated from silicon, drop forming mechanism control circuits 126 can be integrated with the printhead. Printhead 130 also includes a deflection mechanism (not shown in FIG. 1) which is described in more detail below with reference to FIGS. 2 and 3.

Figure 2:
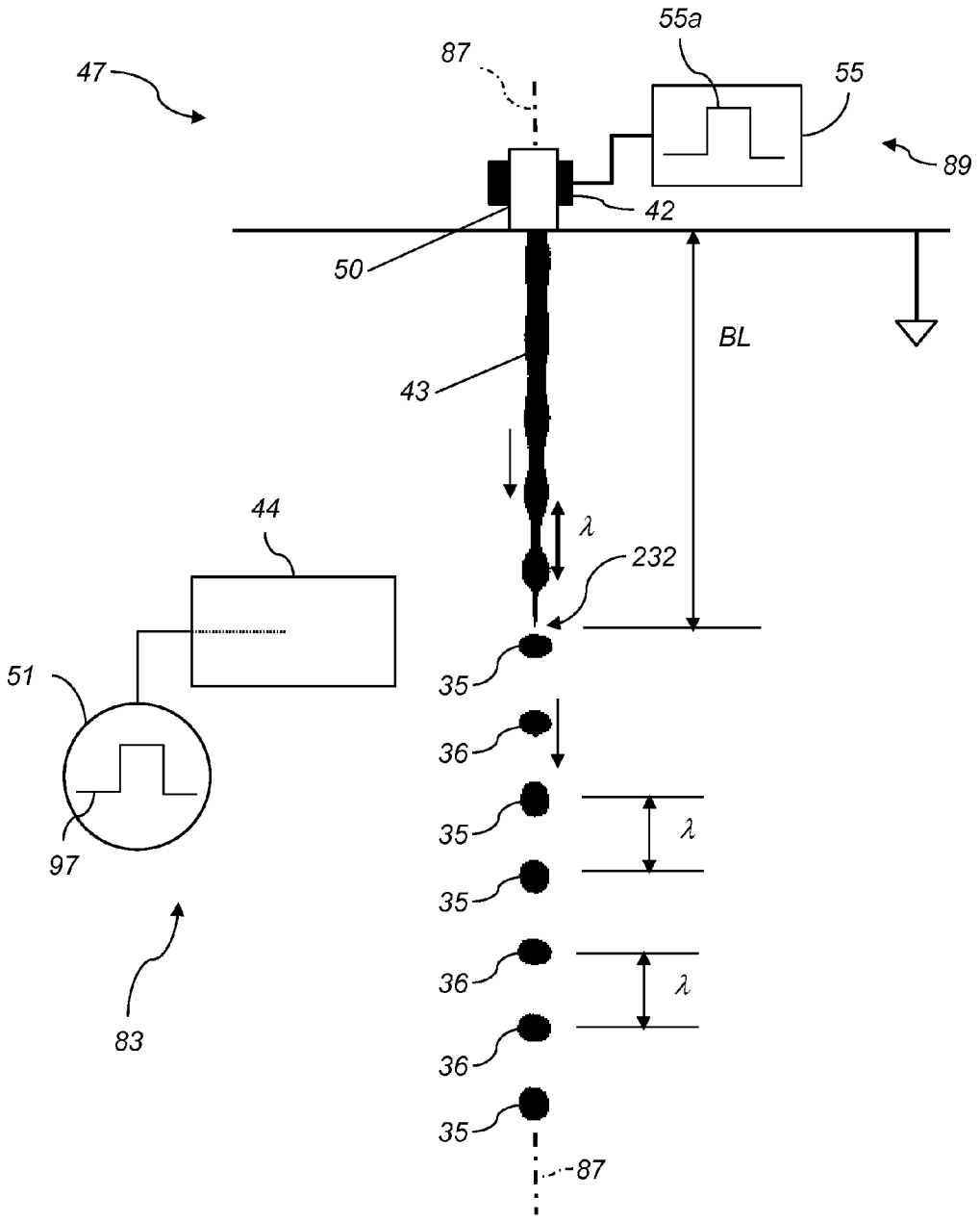
FIG. 2 shows a drop generator for a continuous inkjet printer, and a liquid jet being ejected from the drop generator and its subsequent break-off into drops.

FIG. 2 shows a drop generator for a continuous inkjet printer, and a liquid jet being ejected from the drop generator and its subsequent break-off into drops. Printhead 47 produces from an array of nozzles 50 (only one nozzle is shown) an array of respective liquid jets 43 (one shown) extending along respective axes (one shown as liquid jet axis 87). Associated with each liquid jet 43 is a drop formation device 89. The drop formation device 89 includes a drop formation transducer 42 and a drop formation waveform source 55 that supplies a drop formation waveform 55*a* to drop formation transducer 42. Drop formation transducer 42 can be of any type suitable for creating a perturbation on the liquid jet, such a thermal device, a piezoelectric device, a MEMS actuator, an electrohydrodynamic device, an optical device, an electrostrictive device, or combinations thereof. Depending on the type of transducer 42 used, transducer 42 can be located in or adjacent to a liquid chamber (chamber 24, FIG. 3) that supplies the liquid to nozzle 50. Transducer 42 can thus act on the liquid in the liquid chamber. Transducer 42 can alternatively be located in or immediately around nozzle 50 to act on the liquid as it passes through nozzle 50, or located adjacent to liquid jet 43 to act on liquid jet 43 after it has passed through nozzle 50.

Drop formation waveform source 55 supplies waveform 55*a* having a fundamental frequency $f_o$ and a fundamental period of $T_o=1/f_o$ to drop formation transducer 42, which produces a modulation with a wavelength λ in liquid jet 43. The modulation grows in amplitude to cause portions of the liquid jet 43 to break off into drops. Through the action of drop formation device 89, a sequence of drops 35, 36 are produced at the fundamental frequency $f_o$ (period $T_o$). Waveform 55*a* can also be adjusted to alter the frequency of drop formation.

Liquid jet 43 breaks off into drops, which can have a regular period, at break-off location 232, which is a distance BL from the nozzle 50. The distance between a pair of successive drops 35, 36 is substantially equal to the wavelength λ of the perturbation on the liquid jet. FIG. 2 shows an example of uncharged drops 35 and charged drops 36. The only difference between drops 35 and 36 is the charge state of the drop, discussed below. In this example, drops have been formed in the sequence (bottom or first-broken-off to top or last-broken-off) uncharged drop 35, charged drop 36, charged drop 36, uncharged drop 35, uncharged drop 35, charged drop 36, uncharged drop 35. Any desired sequence of charge states on each drop in a sequence of drops can be produced.

The creation of the drops is associated with an energy supplied by drop formation device 89 operating at the fundamental frequency $f_o$ that creates drops having essentially the same volume separated by the distance λ. "Essentially the same volume" means that the volume of one drop is within ±30% of the volume of the preceding drop. In this example, drops 35 and 36 have essentially the same volume. However drops 35 and 36 can have different volumes. For example, the volume ratio of drop 35 to drop 36 can vary from approximately 4:3 to approximately 3:4. The stimulation for each liquid jet (e.g., jet 43) in FIG. 2 is controlled independently by drop formation transducer 42 associated with the liquid jet or nozzle 50. In one aspect, the drop formation transducer 42 includes one or more electrically-resistive elements adjacent to the nozzle. The liquid jet stimulation is accomplished by sending a periodic current pulse of arbitrary shape, supplied by drop formation waveform source 55, through resistive elements (in transducer 42) surrounding the orifice of nozzle 50. The energy of the current pulse is dissipated in the resistive elements, heating the liquid at the orifice of nozzle 50. The break-off time of the drop for a particular inkjet nozzle is the time from when an amount of liquid leaves nozzle 50 as part of the jet to when that liquid breaks off to form a drop. The jet velocity is controlled by the pressure applied to the liquid chamber and the area of the nozzle orifice. The break-off length BL is equal to the jet velocity times the break-off time. Break-off time can be controlled by adjusting the waveform of the current pulse from source 55: pulse amplitude, duty cycle, or timing relative to other pulses in a sequence of pulses can be adjusted. Small variations of pulse duty cycle or amplitude modulate the drop break-off times in a predictable fashion. Small changes in the amplitude or duty cycle of the stimulation controller to a resistive element surrounding an orifice of the drop generator can also affect the velocity of the drop (e.g., drop 35 or 36) after it breaks off from the liquid jet 43.

Charging device 83 includes charging electrode 44 and charging voltage source 51, which can be a DC or AC voltage or current source. Two spaced-apart electrodes can also be used with appropriate changes to the details below regarding voltage sources. The charge electrode 44 associated with liquid jet 43 is positioned adjacent to the break-off location 232 of liquid jet 43. In this way, electrode 44 is capacitively coupled to jet 43. Jet 43 is grounded (or tied to another voltage), e.g., by contacting the liquid chamber of a grounded drop generator. When a voltage is applied to the charge electrode 44, this capacitive coupling produces a net charge on the end of the electrically conductive liquid jet 43. If the end portion of the liquid jet 43 breaks off to form drop 35 while there is a net charge on the end of the liquid jet 43, the charge of that end portion of the liquid jet 43 is trapped on the newly formed drop 35 or drop 36, so that drop 35 or drop 36 carries that charge.

The voltage on the charging electrode 44 is controlled by a charging voltage source 51 that provides a charge electrode waveform 97. Waveform 97 can be aperiodic or operate at frequency $f_o$, and can be a two-state or multi-state waveform. Thus, the charging voltage source 51 can provide a varying electrical potential between the charging electrode 44 and the liquid jet 43. Each voltage state of the charge electrode waveform 97 can be active for a time interval equal to, e.g., 0.5 $T_o$. Waveform 97 supplied to charge electrode 44 can be dependent on, or independent of (not responsive to), the image data to be printed. In an aspect, waveform 97 is dependent on image data and is aperiodic, and electrode 44 only charges drops from a single nozzle 50. In another aspect, waveform 97 is independent of image data and has a period of $T_o$, and electrode 44 extends substantially parallel to printhead 47 to charge drops from more than one nozzle 50. When electrode 44 charges drops from more than one nozzle 50, waveform 97 is not related to the image data (or else crosstalk could result). When electrode 44 charges drops from only one nozzle 50, waveform 97 can be related to the image data for that nozzle 50, or not. Electrode 44 can be driven between 50 and 400 VDC. Electrode 44 can be offset from nozzle 50 by 50-200 μm, e.g., 100 μm. The electrode voltage can be from 1-3V per μm of offset.

Charging waveform 97 is synchronized to the drop break-off so that one of at least two distinct charge states is imparted to each drop 35, 36. Specifically, charging device 83 is synchronized with drop formation device 89 so that a fixed phase relationship is maintained between the timing of the charge electrode waveform 97 produced by the charging voltage source 51 and the timing of the drop formation waveform source. As a result, the break-off of drops 35, 36 from the liquid jet 43, produced by the drop formation waveform 55*a*, is phase-locked to the charge electrode waveform 97. There can be a phase shift or delay between the charge electrode waveform 97 and drop formation waveform 55*a*. A drop that breaks off from jet 43 while waveform 97 is in the first voltage state has a first charge state with a first charge to mass (q/m) ratio on the first drop 36. A drop that breaks off from jet 43 while waveform 97 is in the second voltage state has a second charge state with a second q/m ratio. Drop charge, drop mass, and drop q/m ratio can be controlled by adjusting waveforms 55*a*, 97 to provide desired charge states on drops 35, 36.

In FIG. 2, transducer 42 includes a heater, for example, an asymmetric heater or a ring heater (either segmented or not segmented), located in a nozzle plate on one or both sides of nozzle 50. Examples of this type of drop formation are described in, for example, U.S. Pat. No. 6,457,807, issued to Hawkins et al., on Oct. 1, 2002; U.S. Pat. No. 6,491,362, issued to Jeanmaire, on Dec. 10, 2002; U.S. Pat. No. 6,505,921, issued to Chwalek et al., on Jan. 14, 2003; U.S. Pat. No. 6,554,410, issued to Jeanmaire et al., on Apr. 29, 2003; U.S. Pat. No. 6,575,566, issued to Jeanmaire et al., on Jun. 10, 2003; U.S. Pat. No. 6,588,888, issued to Jeanmaire et al., on Jul. 8, 2003; U.S. Pat. No. 6,793,328, issued to Jeanmaire, on Sep. 21, 2004; U.S. Pat. No. 6,827,429, issued to Jeanmaire et al., on Dec. 7, 2004; and U.S. Pat. No. 6,851,796, issued to Jeanmaire et al., on Feb. 8, 2005, the disclosures of all of which are incorporated herein by reference.

Various devices for jet breakup can be used. One or two transducers 42 can be used. One transducer can be commonly driven, and velocity-modulating pulses can be provided by another transducer. To charge the drops, drops can be arranged to break off at break-off location 232, so that the charge imparted to the drop depends on the voltage on charge electrode 44 at the break-off time. Transducer 42 can also be arranged or operated to cause drops to be charged to break off at break-off location 232 adjacent to charge electrode 44, and drops not to be charged to break off before or after (above or below) charge electrode 44. In an aspect, the break-off of uncharged drops happens after the end of the jet passes charge electrode 44. This can provide better performance on uncharged drops, since the higher the electric field in which a drop breaks off, i.e., the closer the drop is to electrode 44 at break-off, the more likely the drop will pick up parasitic charge by capacitive or inductive coupling with electrode 44. A piezoelectric ejector can also be used to eject drops directly, in which case break-off happens when the drop is ejected from the liquid reservoir behind the nozzle.

Figure 3:
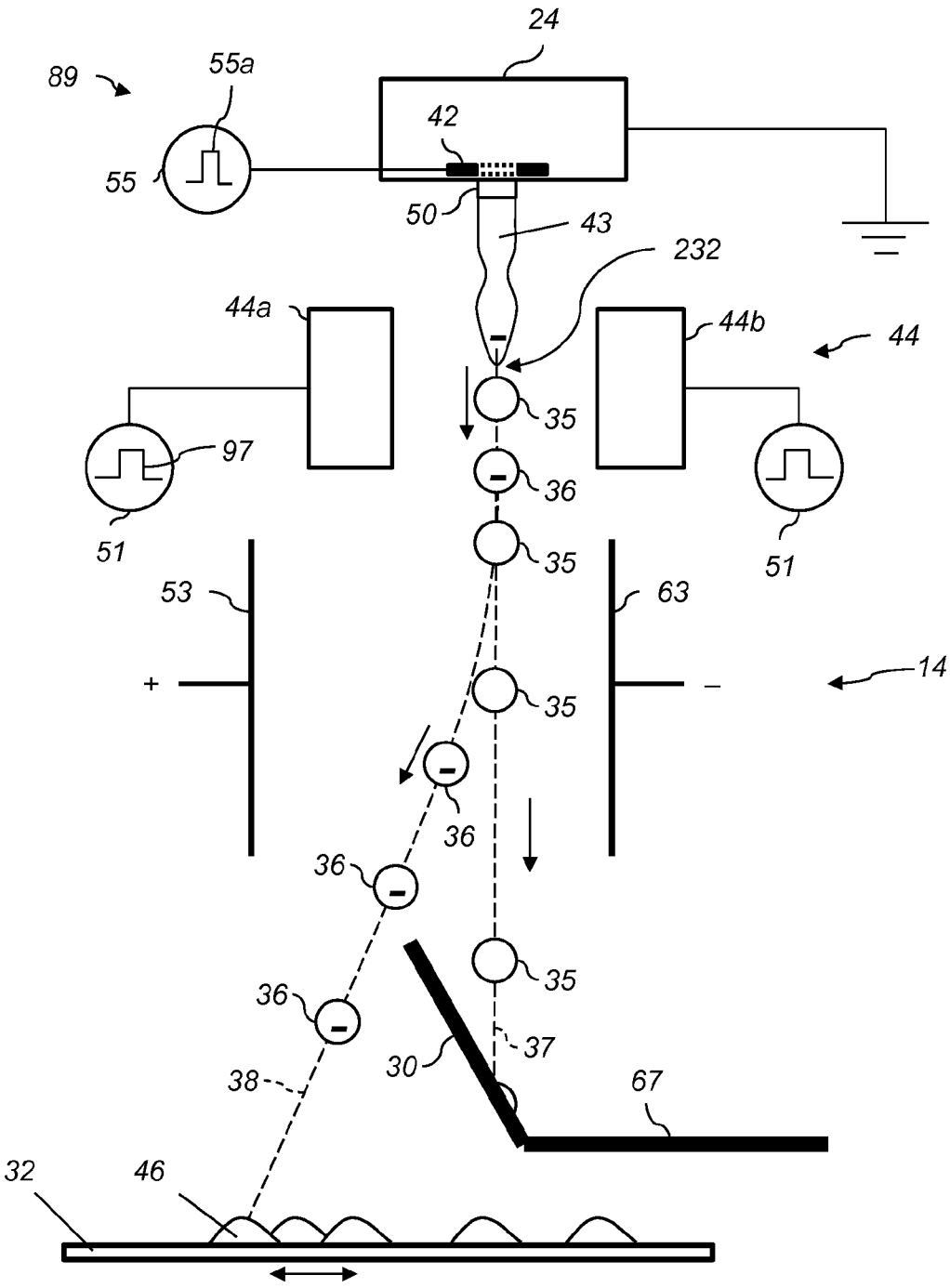
FIG. 3 is a cross-section through a liquid jet of a continuous liquid ejection system and shows deflection of liquid drops.

FIG. 3 is a cross-section of a continuous inkjet system showing deflection of drops. Recording medium 32 is as shown in FIG. 1. Drop formation transducer 42, a drop formation waveform source 55, drop formation waveform 55*a*, nozzle 50, liquid jet 43, drops 35, 36, charging voltage source 51, and charge electrode waveform 97 are as shown in FIG. 2. Liquid chamber 24 is in fluid communication with nozzle 50 (or multiple nozzles in an array).

In this example, drop 36 (FIG. 2) is charged by charge electrode 44 to a first charge state and drop 35 is charged to a second charge state by the charge electrode 44. The two charge states can have opposite signs of charge, or the same sign but different magnitudes. Charge electrode 44 includes a first portion 44*a* and second portion 44*b* positioned on opposite sides of the liquid jet 43, so that drops break off between the two portions. First portion 44*a* and second portion 44*b* of charge electrode 44 can be either separate and distinct electrodes, or separate portions of the same device. Portions 44*a* and 44*b* can be parts of a slit electrode, a continuous conductor around jet 43 with a hole in it through which jet 43 passes. In other examples, only electrode portion 44*a* is used. Portions 44*a* and 44*b* can be arranged so that they do not exert significant force on jet 43 or drops 35, 36 in a direction from one nozzle to another (into or out of the plane of FIG. 3). This can reduce drop-placement errors.

Deflection mechanism 14 includes deflection electrodes 53 and 63 located below break-off location 232. The electrical potential between these two electrodes produces an electric field between the electrodes that deflects negatively charged drops to the left (in this example; deflection can change the path of drops of any selected charge level in any selected direction). The strength of the drop-deflecting electric field depends on the spacing between electrodes 53, 63 and the voltage between them. In this example, deflection electrode 53 is positively biased and the deflection electrode 63 is negatively biased. Biasing these two electrodes in opposite polarities relative to the grounded liquid jet reduces the contribution the deflection electric fields make to the charge of drops 35, 36 breaking off from the liquid jet 43 at break-off location 232.

In this example, portions 44*a*, 44*b* of charge electrode 44 are biased to the same potential by the charging voltage source 51. The addition of the second charge electrode portion 44*b* on the opposite side of liquid jet 43 from the first portion 44*a*, biased to the same potential, produces a region between the charging electrode portions 44*a* and 44*b* with an electric field that is almost symmetric left to right about the center of jet 43. As a result, the charging of drops breaking off from liquid jet 43 between the electrodes 53, 63 is not very sensitive to small changes in the lateral position of jet 43. The near-symmetry of the electric field about liquid jet 43 permits drops 35, 36 to be charged without applying significant lateral deflection forces on drops 35, 36 near break-off at break-off location 232. Similarly, two electrodes can also be used in systems described above with respect to FIG. 2.

Deflection device 14 causes charged drop 36 having a first charge state to travel along first path 38 and uncharged drop 35 having a second charge state to travel along second path 37. "Charged" and "uncharged" are used for this example, but merely signify two different charge states without requiring that either in fact be substantially electrostatically neutral. Deflection device 14 also permits small satellite drops, which can be formed along with normal drops, to merge with a normal drop before drop deflection fields cause the satellite drop and normal drop trajectories to diverge sufficiently that merging becomes improbable. Drop 36 can be charged and drop 35 uncharged or vice versa, one drop can be charged with one sign of charge and the other drop charged with the other sign of charge, or both drops can be charged with the same sign but different magnitudes of charge.

Knife edge catcher 67 intercepts non-deposition drop trajectories. Catcher 67 includes a gutter ledge 30 located below the deflection electrodes 53, 63. Catcher 67 and gutter ledge 30 are oriented so that catcher 67 intercepts drops traveling along the second path 37 for uncharged drops 35, but does not intercept charged drops 36 traveling along first path 38. The catcher can be positioned so that the drops striking the catcher strike the sloped surface of the gutter ledge 30 to reduce splash on impact. Charged drops 36 traveling along the first path 38 are deposited on the recording medium 32, forming printed drops 46. Instead of knife-edge catcher 67, a Coanda catcher, a porous face catcher, a delimited edge catcher, or combinations of any of those can be used.

In an aspect, charging voltage source 51 delivers a 50% duty cycle square wave waveform 97 at the drop fundamental frequency $f_o$. Waveform 55*a* is adjusted, e.g., based on the image data to control the break-off timing of each drop 35, 36. When drop 36 breaks off, electrode 44 has a positive potential on it. Therefore, a negative charge develops on drop 36 as it breaks off from grounded jet 43. When drop 35 breaks off, there is little or no voltage on electrode 44. Therefore, little or no charge is induced on drop 35 as it breaks off from the grounded jet 43. In other aspects, drop 35 is positively charged to further differentiate it from drop 36. A positive potential is placed on deflection electrode 53 which will attract negatively charged drops towards the plane of the deflection electrode 53. Placing a negative voltage on deflection electrode 63 repels the negatively charged drops 36 from deflection electrode 63 to provide additional deflection force on charged drops 36 toward deflection electrode 53. Negative electrode 63 can also attract drops 35 if they are positively charged, and positive electrode 53 can repel them. The fields produced by the applied voltages on deflection electrodes 53, 63 provide sufficient force to drops 36 that they deflect enough to miss gutter ledge 30 and be printed on recording medium 32.

In this example, and throughout this disclosure, positive and negative can be interchanged as appropriate. For example, drops 36 and electrode 63 can be positive and electrode 53 can be negative.

Drop charging and drop deflection can also be incorporated in a single electrode, such as that described in U.S. Pat. No. 4,636,808, incorporated herein by reference. Alternatively, deflection can be accomplished by applying heat asymmetrically to filament of liquid using an asymmetric heater (not shown). When used in this capacity, the asymmetric heater typically operates as the drop forming mechanism in addition to the deflection mechanism. Examples of this type of drop formation and deflection are described in, for example, U.S. Pat. No. 6,079,821, issued to Chwalek et al., on Jun. 27, 2000, the disclosure of which is incorporated herein by reference. Continuous inkjet printer systems can also use pressure-modulation or vibrating-body stimulation devices, or nozzle plates fabricated out of silicon or non-silicon materials or silicon compounds.

Further details of continuous inkjet printers, including gas-flow deflection continuous-inkjet printers, are provided in U.S. patent application Ser. No. 13/115,465, filed May 25, 2011, incorporated herein by reference.

Figure 11:
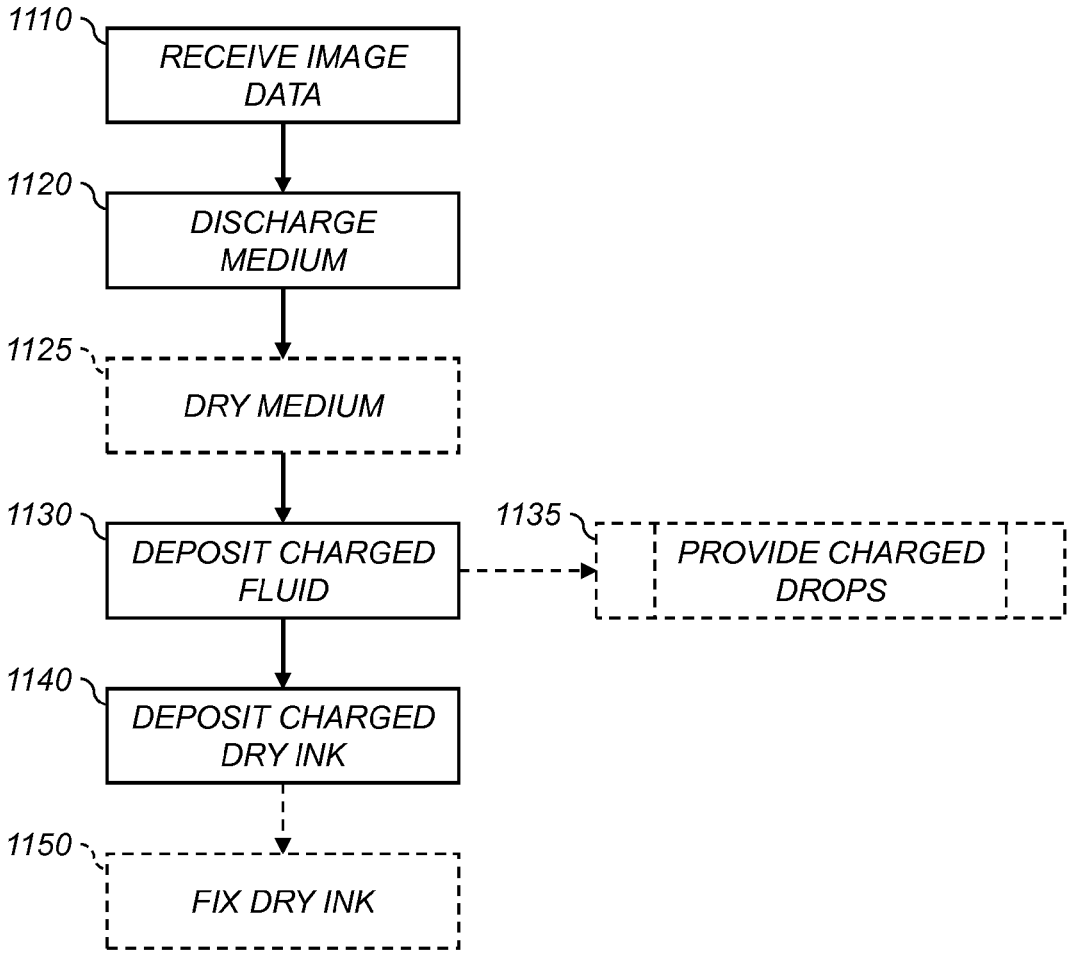
FIG. 11 shows methods of producing a print on a recording medium.

Electrode portions 44*a*, 44*b* can be used to charge charged drop 36, which is then not deflected before striking recording medium 32. In this way, undeflected, highly-charged ink drops strike recording medium 32. Uncharged drops 35 can also be permitted to strike recording medium 32 in a pattern selected so that charged drops 36 and uncharged drops 35 are kept separate from each other on recording medium 32, as discussed below with regard to step 1135 (FIG. 11) In these examples, the pattern of dry ink will be controlled primarily by charged drops 36, as discussed below (FIG. 11).

Figure 4:
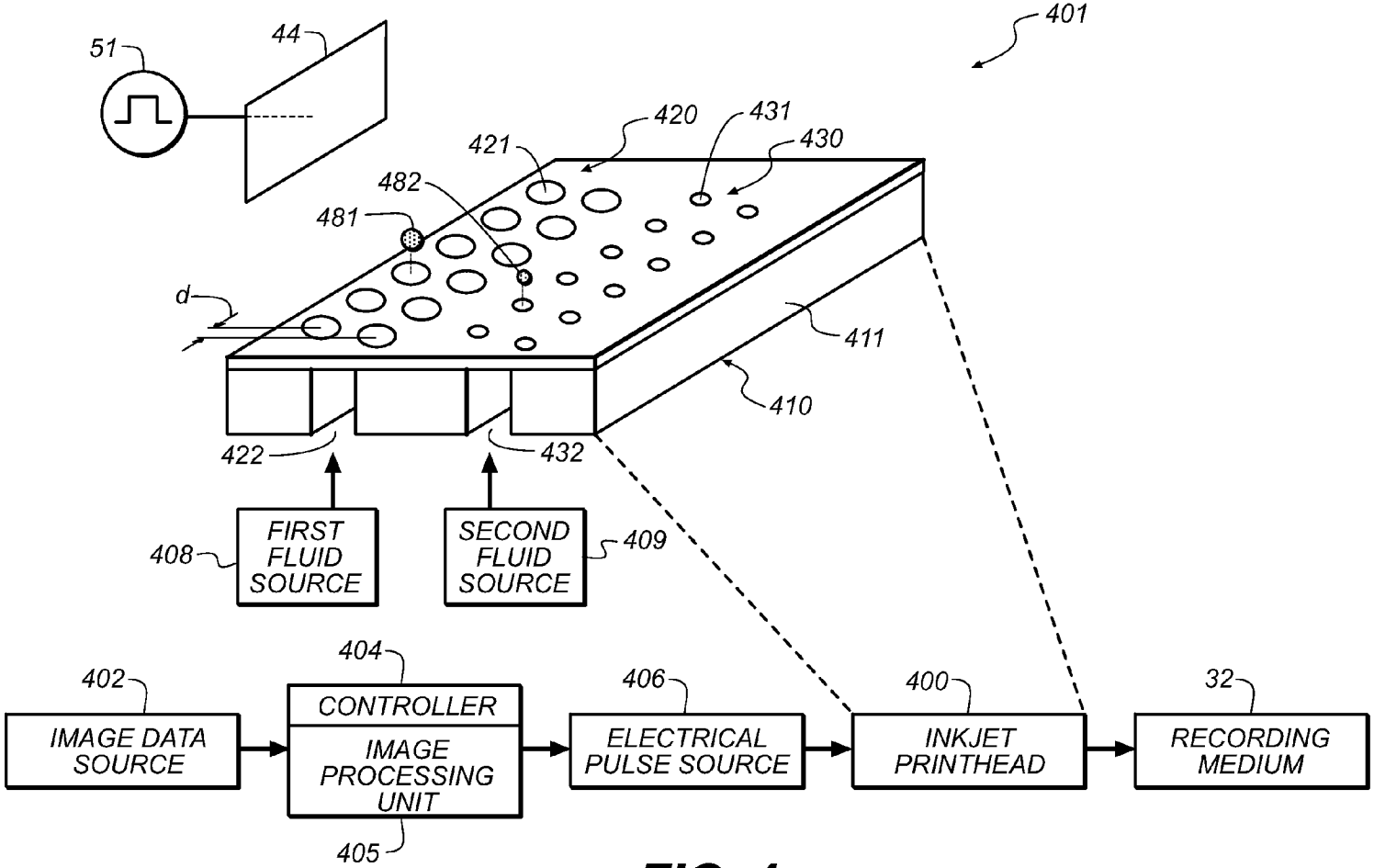
FIG. 4 is a schematic of a drop-on-demand inkjet printer system.

FIG. 4 is a schematic of a drop-on-demand inkjet printer system 401. Further details are provided in U.S. Pat. No. 7,350,902, the disclosure of which is incorporated herein by reference. Inkjet printer system 401 includes an image data source 402, which provides data signals that are interpreted by a controller 404 as being commands to eject drops. Controller 404 includes an image processing unit 405 for rendering images for printing, and outputs signals to an electrical voltage source 406. Electrical voltage source 406 produces electrical energy pulses that are inputted to an inkjet printhead 400 that includes at least one inkjet printhead die 410.

In the example shown in FIG. 4, there are two nozzle arrays. Nozzles 421 in the first nozzle array 420 have a larger opening area than nozzles 431 in the second nozzle array 430. In this example, each of the two nozzle arrays has two staggered rows of nozzles, each row having a nozzle density of 600 per inch. The effective nozzle density then in each array is 1200 per inch (i.e. spacing $d=1/1200$ inch in FIG. 4). If pixels on the recording medium 32 were sequentially numbered along the recording medium advance direction, the nozzles from one row of an array would print the odd numbered pixels, while the nozzles from the other row of the array would print the even numbered pixels.

In fluid communication with each nozzle array is a corresponding ink delivery pathway. Ink delivery pathway 422 is in fluid communication with the first nozzle array 420, and ink delivery pathway 432 is in fluid communication with the second nozzle array 430. Portions of ink delivery pathways 422 and 432 are shown in FIG. 4 as openings through printhead die substrate 411. One or more inkjet printhead die 410 are included in an inkjet printhead, but for greater clarity only one inkjet printhead die 410 is shown in FIG. 4. The printhead die are arranged on a support member. In FIG. 4, first fluid source 408 supplies ink to first nozzle array 420 via ink delivery pathway 422, and second fluid source 409 supplies ink to second nozzle array 430 via ink delivery pathway 432. Although distinct fluid sources 408 and 409 are shown, in some applications it can be beneficial to have a single fluid source supplying ink to both the first nozzle array 420 and the second nozzle array 430 via ink delivery pathways 422 and 432 respectively. Also, in some aspects, fewer than two or more than two nozzle arrays can be included on printhead die 410. In some aspects, all nozzles on inkjet printhead die 410 can be the same size, rather than having multiple sized nozzles on inkjet printhead die 410.

Not shown in FIG. 4 are the drop-forming mechanisms associated with the nozzles. Drop forming mechanisms can be of a variety of types, some of which include a heating element to vaporize a portion of ink and thereby cause ejection of a droplet, or a piezoelectric transducer to constrict the volume of a fluid chamber and thereby cause ejection, or an actuator which is made to move (for example, by heating a bi-layer element) and thereby cause ejection. In any case, electrical pulses from electrical voltage source 406 are sent to the various drop ejectors according to the desired deposition pattern. In the example of FIG. 4, droplets 481 ejected from the first nozzle array 420 are larger than droplets 482 ejected from the second nozzle array 430, due to the larger nozzle opening area. Typically other aspects of the drop forming mechanisms (not shown) associated respectively with nozzle arrays 420 and 430 are also sized differently in order to customize the drop ejection process for the different sized drops. During operation, droplets of ink are deposited on a recording medium 32.

An assembled drop-on-demand inkjet printhead (not shown) includes a plurality of printhead dice, each similar to printhead die 410, and electrical and fluidic connections to those dice. Each die includes one or more nozzle arrays, each connected to a respective ink source. In various aspects, three dice are used, each with two nozzle arrays, and the six nozzle arrays on a printhead are respectively connected to cyan, magenta, yellow, text black, and photo black inks, and a colorless protective printing fluid. Each of the six nozzle arrays is disposed along a nozzle array direction and can be <1 inch long. Typical lengths of recording media are 6 inches for photographic prints (4 inches by 6 inches) or 11 inches for paper (8.5 by 11 inches). Thus, in order to print a full image, a number of swaths are successively printed while moving the printhead across recording medium 32. Following the printing of a swath, the recording medium 32 is advanced along a media advance direction that is substantially parallel to the nozzle array direction.

Charging voltage source 51 and charging electrode 44 are as shown in FIGS. 2 and 3. Source 51 can apply a voltage to electrode 44 to charge drops as they are ejected from grounded nozzles 421, 431. The bulk of the fluid can be grounded. As each drop 481, 482 is ejected from nozzle 421, 431, it breaks away very quickly from the fluid mass in the printhead. Electrode 44 can apply a voltage during that break-off to charge the drops, e.g., as discussed above with reference to FIG. 2. Alternatively, the fluid in ink delivery pathways 422, 432 can be electrically charged before jetting, e.g., by biasing printhead die substrate 411 or a nozzle plate. Alternatively, a charging electrode (e.g., a pin electrode; not shown) can be provided in each nozzle 421, 431.

Figure 5:
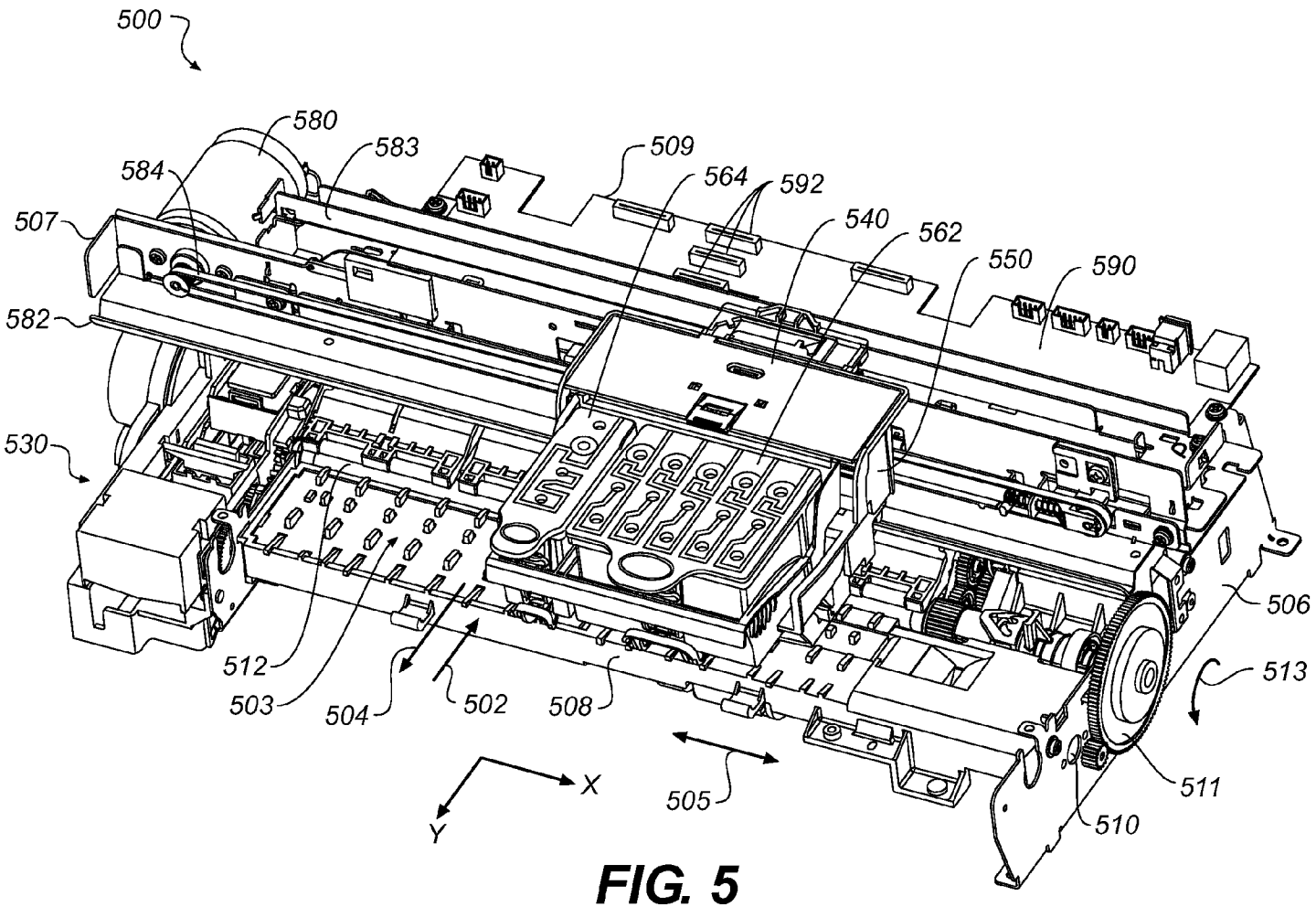
FIG. 5 is a perspective of a portion of a drop-on-demand inkjet printer.

FIG. 5 is a perspective of a portion of a drop-on-demand inkjet printer. Some of the parts of the printer have been hidden in the view shown in FIG. 5 so that other parts can be more clearly seen. Printer chassis 500 has a print region 503 across which carriage 540 is moved back and forth in carriage scan direction 505 along the X axis, between the right side 506 and left side 507 of printer chassis 500, while drops are ejected from printhead die 410 (not shown in FIG. 5) on printhead assembly 550 that is mounted on carriage 540. Carriage motor 580 moves belt 584 to move carriage 540 along carriage guide rail 582. An encoder sensor (not shown) is mounted on carriage 540 and indicates carriage location relative to an encoder fence 583.

Printhead assembly 550 is mounted in carriage 540, and multi-chamber ink tank 562 and single-chamber ink tank 564 are installed in printhead assembly 550. A printhead together with installed ink tanks is sometimes called a printhead assembly. The mounting orientation of printhead assembly 550 as shown here is such that the printhead die 410 (FIG. 4) are located at the bottom side of printhead assembly 550, the droplets of ink being ejected downward onto the recording medium (not shown) in print region 503 in the view of FIG. 5. Multi-chamber ink tank 562, in this example, contains five ink sources: cyan, magenta, yellow, photo black, and colorless protective fluid; while single-chamber ink tank 564 contains the ink source for text black. In other aspects, rather than having a multi-chamber ink tank to hold several ink sources, all ink sources are held in individual single chamber ink tanks. Paper or other recording medium (sometimes generically referred to as paper or media herein) is loaded along paper load entry direction 502 toward front 508 of printer chassis 500.

A variety of rollers can be used to advance the recording medium through the printer. In an aspect, a pick-up roller (not shown) moves the top piece or sheet of a stack of paper or other recording medium in a paper load entry direction. A turn roller (not shown) acts to move the paper around a C-shaped path (in cooperation with a curved rear wall surface) so that the paper is oriented to advance along media advance direction 504 from rear 509 of printer chassis 500 (in the +Y direction of the Y axis). The paper is then moved by the feed roller and one or more idler roller(s) to advance along media advance direction 504 across print region 503, and from there to a discharge roller (not shown) and star wheel(s) so that printed paper exits along the media advance direction 504. Feed roller 512 includes a feed roller shaft along its axis, and feed roller gear 511 is mounted on the feed roller shaft. Feed roller 512 can include a separate roller mounted on the feed roller shaft, or can include a thin high friction coating on the feed roller shaft. A rotary encoder (not shown) can be coaxially mounted on the feed roller shaft in order to monitor the angular rotation of the feed roller.

The motor that powers the paper advance rollers is not shown in FIG. 5. Hole 510 at right side 506 of the printer chassis 500 is where the motor gear (not shown) protrudes through in order to engage feed roller gear 511 and the gear for the discharge roller (not shown). For normal paper pick-up and feeding, it is desired that the rollers rotate together in forward rotation direction 513. Maintenance station 530 is located toward left side 507 of printer chassis 500.

Toward the rear 509 of the printer chassis 500, in this example, is located the electronics board 590, which includes cable connectors 592 for communicating via cables (not shown) to the printhead carriage 540 and from there to the printhead assembly 550. Also on the electronics board 590 are mounted motor controllers for the carriage motor 580 and for the paper advance motor, a processor or other control electronics (shown schematically as controller 404 and image processing unit 405 in FIG. 4) for controlling the printing process, and an optional connector for a cable to a host computer.

Figure 6:
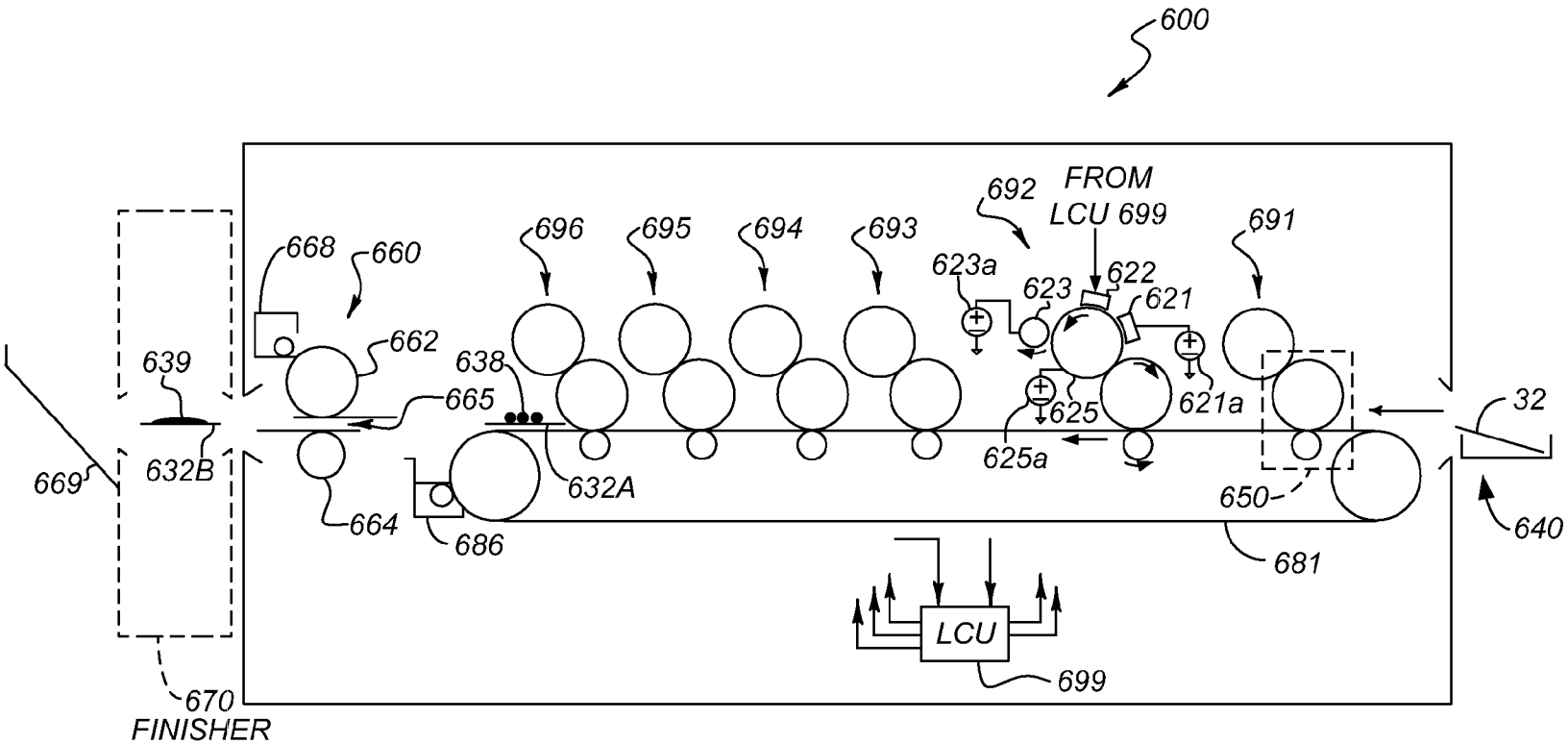
FIG. 6 is an elevational cross-section of an electrophotographic reproduction apparatus.

FIG. 6 is an elevational cross-section of an electrophotographic reproduction apparatus. In an electrophotographic modular printing machine, e.g. the NEXPRESS 3000SE printer manufactured by Eastman Kodak Company of Rochester, N.Y., color-dry ink print images are made in a plurality of color imaging modules arranged in tandem, and the print images are successively electrostatically transferred to a recording medium adhered to a transport web moving through the modules. Colored dry inks include colorants, e.g. dyes or pigments, which absorb specific wavelengths of visible light. Commercial machines of this type typically employ intermediate transfer members in the respective modules for transferring visible images from the photoreceptor and transferring print images to the recording medium. In other electrophotographic printers, each visible image is directly transferred to a recording medium to form the corresponding print image.

Electrophotographic printers having the capability to also deposit clear dry ink using an additional imaging module are also known. As used herein, clear dry ink is considered to be a color of dry ink, as are C, M, Y, K, and Lk, but the term "colored dry ink" excludes clear dry inks. The provision of a clear-dry ink overcoat to a color print is desirable for providing protection of the print from fingerprints and reducing certain visual artifacts. Clear dry ink uses particles that are similar to the dry ink particles of the color development stations but without colored material (e.g. dye or pigment) incorporated into the dry ink particles. However, a clear-dry ink overcoat can add cost and reduce color gamut of the print; thus, it is desirable to provide for operator/user selection to determine whether or not a clear-dry ink overcoat will be applied to the entire print. A uniform layer of clear dry ink can be provided. A layer that varies inversely according to heights of the dry ink stacks can also be used to establish level dry ink stack heights. The respective dry inks are deposited one upon the other at respective locations on the recording medium and the height of a respective dry ink stack is the sum of the dry ink heights of each respective color. Uniform stack height provides the print with a more even or uniform gloss.

Referring to FIG. 6, printer 600 is adapted to produce print images, such as single-color (monochrome), CMYK, or hexachrome (six-color) images, on a recording medium (multicolor images are also known as "multi-component" images). Images can include text, graphics, photos, and other types of visual content. One aspect involves printing using an electrophotographic print engine having six sets of single-color image-producing or -printing stations or modules arranged in tandem, but more or fewer than six colors can be combined to form a print image on a given recording medium. Other electrophotographic writers or printer apparatus can also be included. Various components of printer 600 are shown as rollers; other configurations are also possible, including belts.

Referring to FIG. 6, printer 600 is an electrophotographic printing apparatus having a number of tandemly-arranged electrophotographic image-forming printing modules 691, 692, 693, 694, 695, 696, also known as electrophotographic imaging subsystems. Each printing module produces a single-color dry ink image for transfer using a respective transfer subsystem 650 (for clarity, only one is labeled) to a recording medium 32 successively moved through the modules. Recording medium 32 is transported from supply unit 640, which can include active feeding subsystems as known in the art, into printer 600. In various aspects, the visible image can be transferred directly from an imaging roller to a recording medium, or from an imaging roller to one or more transfer roller(s) or belt(s) in sequence in transfer subsystem 650, and thence to recording medium 32. Recording medium 32 is, for example, a selected section of a web of, or a cut sheet of, planar media such as paper or transparency film.

Each printing module 691, 692, 693, 694, 695, 696 includes various components. For clarity, these are only shown in printing module 692. Around photoreceptor 625 are arranged, ordered by the direction of rotation of photoreceptor 625, charger 621, exposure subsystem 622, and toning station 623.

In the EP process, an electrostatic latent image is formed on photoreceptor 625 by uniformly charging photoreceptor 625 and then discharging selected areas of the uniform charge to yield an electrostatic charge pattern corresponding to the desired image (a "latent image"). Charger 621 produces a uniform electrostatic charge on photoreceptor 625 or its surface. Exposure subsystem 622 selectively image-wise discharges photoreceptor 625 to produce a latent image. Exposure subsystem 622 can include a laser and raster optical scanner (ROS), one or more LEDs, or a linear LED array.

After the latent image is formed, charged dry ink particles are brought into the vicinity of photoreceptor 625 by toning station 623 and are attracted to the latent image to develop the latent image into a visible image. Note that the visible image may not be visible to the naked eye depending on the composition of the dry ink particles (e.g. clear dry ink). Toning station 623 can also be referred to as a development station. Dry ink can be applied to either the charged or discharged parts of the latent image.

After the latent image is developed into a visible image on the photoreceptor 625, a suitable recording medium is brought into juxtaposition with the visible image. In transfer subsystem 650, a suitable electric field is applied to transfer the dry ink particles of the visible image to the recording medium to form the desired print image on the recording medium. The imaging process is typically repeated many times with reusable photoreceptors.

The recording medium is then removed from its operative association with the photoreceptor 625 and subjected to heat or pressure to permanently fix ("fuse") the print image to the recording medium. Plural print images, e.g. of separations of different colors, are overlaid on one recording medium before fusing to form a multi-color print image on the recording medium.

Each recording medium, during a single pass through the six modules, can have transferred in registration thereto up to six single-color dry ink images to form a pentachrome image. As used herein, the term "hexachrome" implies that in a print image, combinations of various of the six colors are combined to form other colors on the recording medium at various locations on the recording medium. That is, each of the six colors of dry ink can be combined with dry ink of one or more of the other colors at a particular location on the recording medium to form a color different than the colors of the dry inks combined at that location. In an aspect, printing module 691 forms black (K) print images, printing module 692 forms yellow (Y) print images, printing module 693 forms magenta (M) print images, printing module 694 forms cyan (C) print images, printing module 695 forms light-black (Lk) images, and printing module 696 forms clear images.

In various aspects, printing module 696 forms a print image using a clear dry ink or tinted dry ink. Tinted dry inks absorb less light than they transmit, but do contain pigments or dyes that move the hue of light passing through them towards the hue of the tint. For example, a blue-tinted dry ink coated on white paper will cause the white paper to appear light blue when viewed under white light, and will cause yellows printed under the blue-tinted dry ink to appear slightly greenish under white light.

Recording medium 632A is shown after passing through printing module 696. Print image 638 on recording medium 632A includes unfused dry ink particles.

Subsequent to transfer of the respective print images, overlaid in registration, one from each of the respective printing modules 691, 692, 693, 694, 695, 696, recording medium 632A is advanced to a fuser 660, i.e. a fusing or fixing assembly, to fuse print image 638 to recording medium 632A. Transport web 681 transports the print-image-carrying recording media to fuser 660, which fixes the dry ink particles to the respective recording media by the application of heat and pressure. The recording media are serially de-tacked from transport web 681 to permit them to feed cleanly into fuser 660. Transport web 681 is then reconditioned for reuse at cleaning station 686 by cleaning and neutralizing the charges on the opposed surfaces of the transport web 681. A mechanical cleaning station (not shown) for scraping or vacuuming dry ink off transport web 681 can also be used independently or with cleaning station 686. The mechanical cleaning station can be disposed along transport web 681 before or after cleaning station 686 in the direction of rotation of transport web 681.

Fuser 660 includes a heated fusing roller 662 and an opposing pressure roller 664 that form a fusing nip 665 therebetween. In an aspect, fuser 660 also includes a release fluid application substation 668 that applies release fluid, e.g. silicone oil, to fusing roller 662. Alternatively, wax-containing dry ink can be used without applying release fluid to fusing roller 662. Other aspects of fusers, both contact and non-contact, can be employed with various aspects. For example, solvent fixing uses solvents to soften the dry ink particles so they bond with the recording medium. Photoflash fusing uses short bursts of high-frequency electromagnetic radiation (e.g. ultraviolet light) to melt the dry ink. Radiant fixing uses lower-frequency electromagnetic radiation (e.g. infrared light) to more slowly melt the dry ink. Microwave fixing uses electromagnetic radiation in the microwave range to heat the recording media (primarily), thereby causing the dry ink particles to melt by heat conduction, so that the dry ink is fixed to the recording medium.

The recording media (e.g. recording medium 632B) carrying the fused image (e.g., fused image 639) are transported in a series from the fuser 660 along a path either to a remote output tray 669, or back to printing modules 691, 692, 693, 694, 695, 696 to create an image on the backside of the recording medium, i.e. to form a duplex print. Recording media can also be transported to any suitable output accessory. For example, an auxiliary fuser or glossing assembly can provide a clear-dry ink overcoat. Printer 600 can also include multiple fusers 660 to support applications such as overprinting, as known in the art.

In various aspects, between fuser 660 and output tray 669, recording medium 632B passes through finisher 670. Finisher 670 performs various media-handling operations, such as folding, stapling, saddle-stitching, collating, and binding.

Printer 600 includes main printer apparatus logic and control unit (LCU) 699, which receives input signals from the various sensors associated with printer 600 and sends control signals to the components of printer 600. LCU 699 can include a microprocessor incorporating suitable look-up tables and control software executable by the LCU 699. It can also include a field-programmable gate array (FPGA), programmable logic device (PLD), microcontroller, or other digital control system. LCU 699 can include memory for storing control software and data. Sensors associated with the fusing assembly provide appropriate signals to the LCU 699. In response to the sensors, the LCU 699 issues command and control signals that adjust the heat or pressure within fusing nip 665 and other operating parameters of fuser 660 for recording media. This permits printer 600 to print on recording media of various thicknesses and surface finishes, such as glossy or matte.

Image data for writing by printer 600 can be processed by a raster image processor (RIP; not shown), which can include a color separation screen generator or generators. The output of the RIP can be stored in frame or line buffers for transmission of the color separation print data to each of respective LED writers, e.g. for black (K), yellow (Y), magenta (M), cyan (C), and red (R), respectively. The RIP or color separation screen generator can be a part of printer 600 or remote therefrom. Image data processed by the RIP can be obtained from a color document scanner or a digital camera or produced by a computer or from a memory or network which typically includes image data representing a continuous image that needs to be reprocessed into halftoned image data in order to be adequately represented by the printer. The RIP can perform image processing processes, e.g. color correction, in order to obtain the desired color print. Color image data is separated into the respective colors and converted by the RIP to halftoned dot image data in the respective color using matrices, which comprise desired screen angles (measured counterclockwise from rightward, the +X direction) and screen rulings. The RIP can be a suitably-programmed computer or logic device and is adapted to employ stored or computed matrices and templates for processing separated color image data into rendered image data in the form of halftoned information suitable for printing. These matrices can include a screen pattern memory (SPM).

Various parameters of the components of a printing module (e.g., printing module 691) can be selected to control the operation of printer 600. In an aspect, charger 621 is a corona charger including a grid between the corona wires (not shown) and photoreceptor 625. Voltage source 621*a* applies a voltage to the grid to control charging of photoreceptor 625. In an aspect, a voltage bias is applied to toning station 623 by voltage source 623*a* to control the electric field, and thus the rate of dry ink transfer, from toning station 623 to photoreceptor 625. In an aspect, a voltage is applied to a conductive base layer of photoreceptor 625 by voltage source 625*a* before development, that is, before dry ink is applied to photoreceptor 625 by toning station 623. The applied voltage can be zero; the base layer can be grounded. This also provides control over the rate of dry ink deposition during development. In an aspect, the exposure applied by exposure subsystem 622 to photoreceptor 625 is controlled by LCU 699 to produce a latent image corresponding to the desired print image. All of these parameters can be changed, as described below.

Further details regarding printer 600 are provided in U.S. Pat. No. 6,608,641, issued on Aug. 19, 2003, to Peter S. Alexandrovich et al., and in U.S. Publication No. 2006/0133870, published on Jun. 22, 2006, by Yee S. Ng et al., the disclosures of which are incorporated herein by reference.

Figure 7:
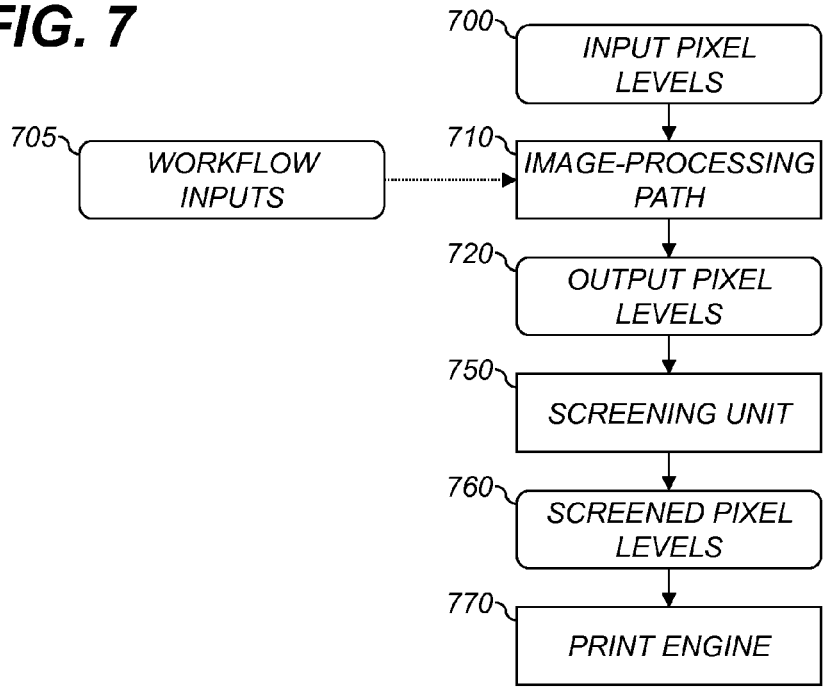
FIG. 7 is a schematic of a data-processing path.

FIG. 7 is a schematic of a data-processing path, and defines several terms used herein. Continuous printing system 120 (FIG. 1), inkjet printer system 401 (FIG. 4), printer 600 (FIG. 6), or electronics corresponding to any of these (e.g. the DFE or RIP, described herein), can operate this datapath to produce image data corresponding to exposure to be applied to a photoreceptor or ink quantity to be applied to a recording medium, as described above. This data path can also provide data for other types of printers. The data path can be partitioned in various ways between the DFE and the print engine, as is known in the image-processing art.

The following discussion relates to a single pixel; in operation, data processing takes place for a plurality of pixels that together compose an image. The term "resolution" herein refers to spatial resolution, e.g. in cycles per degree. The term "bit depth" refers to the range and precision of values. Each set of pixel levels has a corresponding set of pixel locations. Each pixel location is the set of coordinates on the surface of recording medium 32 (FIG. 6) at which an amount of dry ink corresponding to the respective pixel level should be applied.

Printer 600 receives input pixel levels 700. These can be any level known in the art, e.g. sRGB code values (0 . . . 255) for red, green, and blue (R, G, B) color channels. There is one pixel level for each color channel. Input pixel levels 700 can be in an additive or subtractive space. Image-processing path 710 converts input pixel levels 700 to output pixel levels 720, which can be cyan, magenta, yellow (CMY); cyan, magenta, yellow, black (CMYK); or values in another subtractive color space. This conversion can be part of the color-management system discussed above. Output pixel level 720 can be linear or non-linear with respect to exposure, L*, or other factors known in the art.

Image-processing path 710 transforms input pixel levels 700 of input color channels (e.g. R) in an input color space (e.g. sRGB) to output pixel levels 720 of output color channels (e.g. C) in an output color space (e.g. CMYK). In various aspects, image-processing path 710 transforms input pixel levels 700 to desired CIELAB (CIE 1976 L*a*b*; CIE Pub. 15:2004, 3rd. ed., §8.2.1) values or ICC PCS (Profile Connection Space) LAB values, and thence optionally to values representing the desired color in a wide-gamut encoding such as ROMM RGB. The CIELAB, PCS LAB or ROMM RGB values are then transformed to device-dependent CMYK values to maintain the desired colorimetry of the pixels. Image-processing path 710 can use optional workflow inputs 705, e.g. ICC profiles of the image and the printer 600, to calculate the output pixel levels 720. RGB can be converted to CMYK according to the Specifications for Web Offset Publications (SWOP; ANSI CGATS TR001 and CGATS.6), Euroscale (ISO 2846-1:2006 and ISO 12647), or other CMYK standards.

Input pixels are associated with an input resolution in pixels per inch (ippi, input pixels per inch), and output pixels with an output resolution (oppi). Image-processing path 710 scales or crops the image, e.g. using bicubic interpolation, to change resolutions when ippi oppi. The following steps in the path (output pixel levels 720, screened pixel levels 760) are preferably also performed at oppi, but each can be a different resolution, with suitable scaling or cropping operations between them.

Screening unit 750 calculates screened pixel levels 760 from output pixel levels 720. Screening unit 750 can perform continuous-tone (processing), halftone, multitone, or multilevel halftone processing, and can include a screening memory or dither bitmaps. Screened pixel levels 760 are at the bit depth required by print engine 770.

Print engine 770 represents the subsystems in printer 600 that apply an amount of dry ink corresponding to the screened pixel levels to a recording medium 32 (FIG. 6) at the respective screened pixel locations. Examples of these subsystems are described above with reference to FIGS. 1-3. The screened pixel levels and locations can be the engine pixel levels and locations, or additional processing can be performed to transform the screened pixel levels and locations into the engine pixel levels and locations.

Figure 8:
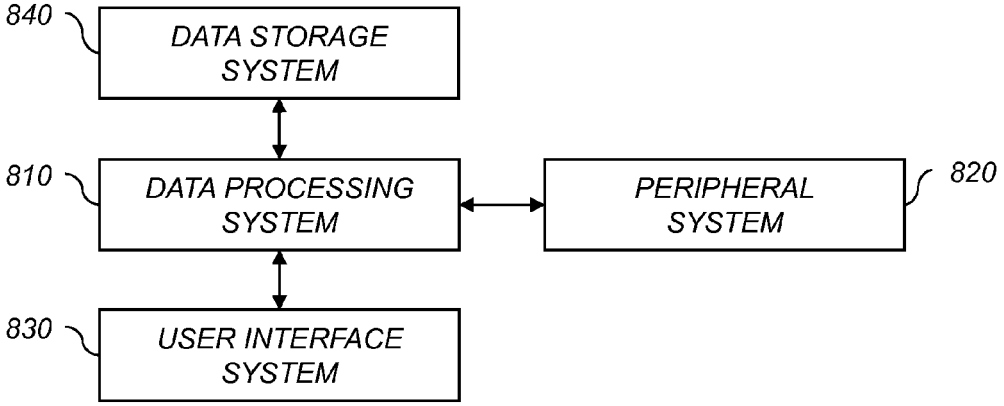
FIG. 8 is a high-level diagram showing the components of a processing system.

FIG. 8 is a high-level diagram showing the components of a processing system. The system includes a data processing system 810, a peripheral system 820, a user interface system 830, and a data storage system 840. Peripheral system 820, user interface system 830 and data storage system 840 are communicatively connected to data processing system 810.

Data processing system 810 includes one or more data processing devices that implement the processes of various aspects, including the example processes described herein. The phrases "data processing device" or "data processor" are intended to include any data processing device, such as a central processing unit ("CPU"), a desktop computer, a laptop computer, a mainframe computer, a personal digital assistant, a Blackberry™, a digital camera, cellular phone, or any other device for processing data, managing data, or handling data, whether implemented with electrical, magnetic, optical, biological components, or otherwise.

Data storage system 840 includes one or more processor-accessible memories configured to store information, including the information needed to execute the processes of the various aspects, including the example processes described herein. Data storage system 840 can be a distributed processor-accessible memory system including multiple processor-accessible memories communicatively connected to data processing system 810 via a plurality of computers or devices. On the other hand, data storage system 840 need not be a distributed processor-accessible memory system and, consequently, can include one or more processor-accessible memories located within a single data processor or device.

The phrase "processor-accessible memory" is intended to include any processor-accessible data storage device, whether volatile or nonvolatile, electronic, magnetic, optical, or otherwise, including but not limited to, registers, floppy disks, hard disks, Compact Discs, DVDs, flash memories, ROMs, and RAMs.

The phrase "communicatively connected" is intended to include any type of connection, whether wired or wireless, between devices, data processors, or programs in which data can be communicated. The phrase "communicatively connected" is intended to include a connection between devices or programs within a single data processor, a connection between devices or programs located in different data processors, and a connection between devices not located in data processors at all. In this regard, although the data storage system 840 is shown separately from data processing system 810, one skilled in the art will appreciate that data storage system 840 can be stored completely or partially within data processing system 810. Further in this regard, although peripheral system 820 and user interface system 830 are shown separately from data processing system 810, one skilled in the art will appreciate that one or both of such systems can be stored completely or partially within data processing system 810.

Peripheral system 820 can include one or more devices configured to provide digital content records to data processing system 810. For example, peripheral system 820 can include digital still cameras, digital video cameras, cellular phones, or other data processors. Data processing system 810, upon receipt of digital content records from a device in peripheral system 820, can store such digital content records in data storage system 840. Peripheral system 820 can also include a printer interface for causing a printer to produce output corresponding to digital content records stored in data storage system 840 or produced by data processing system 810.

User interface system 830 can include a mouse, a keyboard, another computer, or any device or combination of devices from which data is input to data processing system 810. In this regard, although peripheral system 820 is shown separately from user interface system 830, peripheral system 820 can be included as part of user interface system 830.

User interface system 830 also can include a display device, a processor-accessible memory, or any device or combination of devices to which data is output by data processing system 810. In this regard, if user interface system 830 includes a processor-accessible memory, such memory can be part of data storage system 840 even though user interface system 830 and data storage system 840 are shown separately in FIG. 8.

Figure 9:
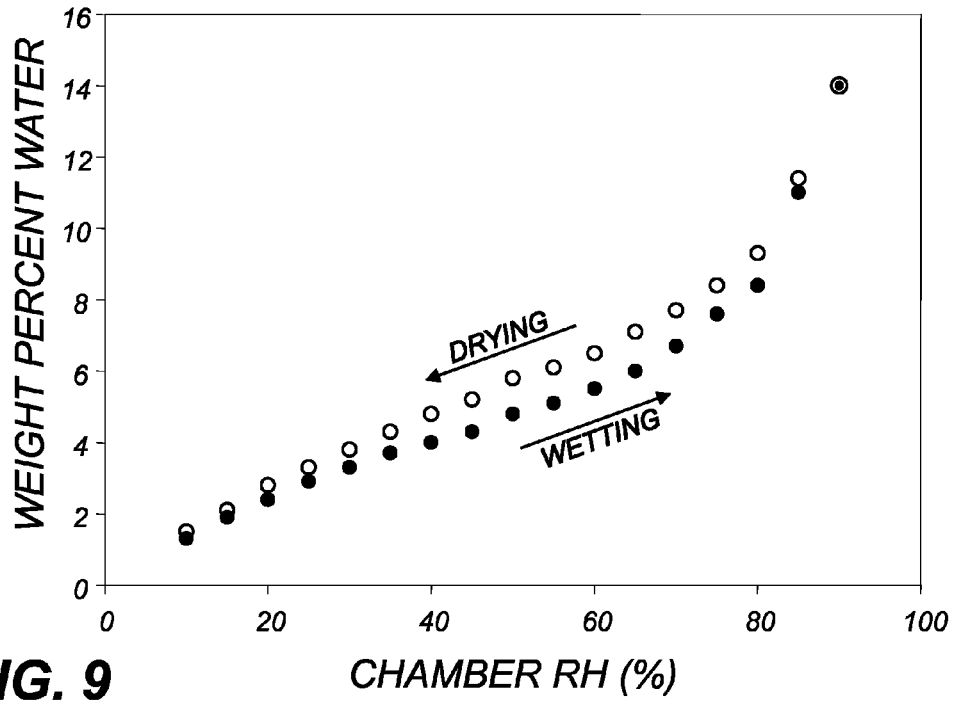
FIG. 9 shows the moisture content of a representative paper equilibrated to the relative humidity.

FIG. 9 shows the moisture content of a selected representative paper, measured in weight percent of water, as a function of atmospheric relative humidity (RH), measured in percent. To take these measurements, the paper was placed in a chamber containing air at low RH. The moisture content of the chamber was increased in a series of steps. At each step, the paper was left in the chamber for enough time to permit it to equilibrate with the atmosphere in the chamber. The moisture content of the paper was measured. The resulting data are shown in the solid circles ("wetting"). After reaching a high RH, the chamber RH was reduced stepwise. As before, at each step the paper was permitted to equilibrate, then was measured. The resulting data are shown in the open circles ("drying"). As shown, there is some hysteresis in the moisture content.

Figure 10:
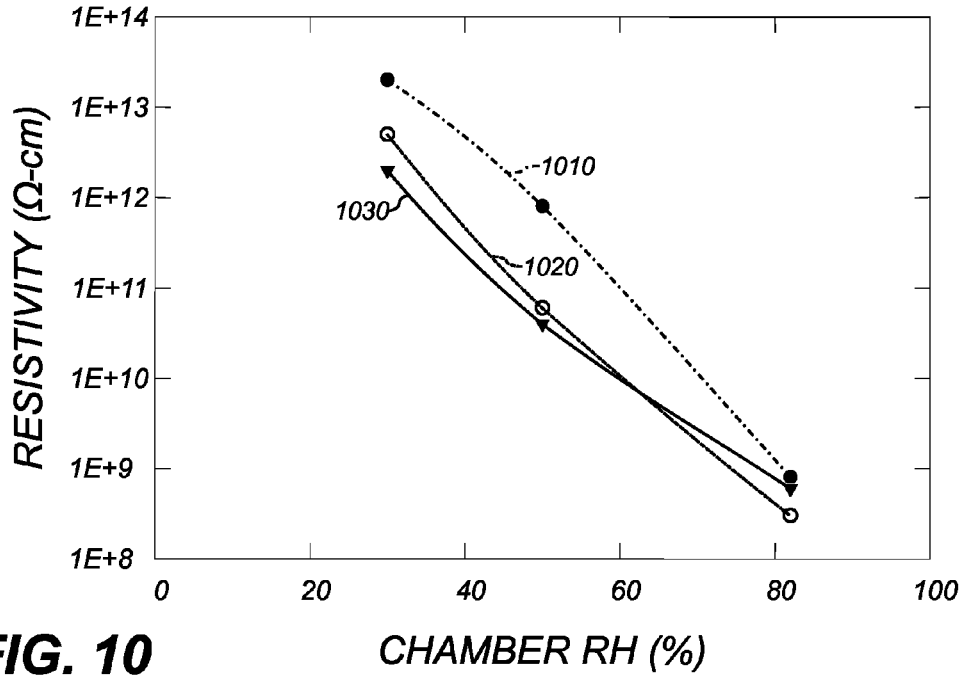
FIG. 10 shows the electrical resistivity of three types of paper as a function of the relative humidity.

FIG. 10 shows the electrical resistivity (Ω-cm) of three types of paper as a function of atmospheric relative humidity, as defined above with reference to FIG. 9. The abscissa is chamber RH and the ordinate is resistivity, plotted on a $\log_{10}$ scale from 100 MΩ to 100 TΩ. Curve 1010 is for a 60-lb. (60#) KROMEKOTE paper, curve 1020 is for a 70# POTLATCH VINTAGE paper, and curve 1030 is for a 20# UNISOURCE bond paper. As RH increases from under 40% to over 80%, resistivity drops by three to four orders of magnitude.

As a result of this resistivity, low-equilibrated-RH (e.g., dry) paper can hold an electric charge. If electric charge is deposited onto an electrically grounded material, an electrically leaky capacitor is formed. The electric charge will exponentially decay with a time constant $\tau$ given by the product of the resistivity of the material and the dielectric constant of the material. In a period equal to one time constant, the charge and resulting potential on the material will decay to 1/e or approximately 1/2.7 (≈37%) of its initial value (e=ln(1)). In a period $5\tau$ long, 99.3% of the charge and potential will dissipate. The dielectric constant of paper is approximately 3 times the permittivity of free space or $\sim 3\times(8.85\times10^{-12})$ F/m. As shown in FIG. 10, the resistivity of paper whose moisture content is equilibrated to 50% RH is approximately $1\times10^{11}$ Ω-cm or $1\times10^{9}$ Ω-m. Thus, $\tau\approx0.027$ s, so in 0.13 s 99.7% of the charge deposited on paper whose moisture content is equilibrated to 50% RH will be dissipated. However, if the paper is dried to a moisture content equilibrated to 20% RH, the resistivity increases to between $10^{12}$ and $10^{14}$ Ω-cm. For a resistivity of $10^{13}$ Ω-cm=$10^{11}$ Ω-m, τ≈267 s, so the charge and resulting voltage on the recording medium would only decay by 3.7% in ten seconds. In various aspects described below, paper is dried to an equilibrated RH providing sufficient resistivity that the amount of discharge in ten seconds is acceptable.

FIG. 11 shows methods of producing a print on a recording medium. Some methods described herein use discharged-area development (DAD); others used charged-area development (CAD). Processing begins with step 1110.

In step 1110, positive or negative image data is received for the print to be produced. Positive image data is used for CAD and negative image data for DAD. Negative image data can also be received and converted into positive image data using a microprocessor, or positive image data can be received for DAD and converted into negative image data using the microprocessor. Step 1110 is followed by step 1120.

In step 1120, a selected region of the recording medium is discharged. The selected region is an area of the recording medium in or on which the image will be formed. The region can extend beyond the image eventually formed, and can include the entire surface of that side of the recording medium on which the dry ink will be deposited (step 1140, below). The medium can be brought into contact with a grounded or other strapped electrode, or exposed to moisture to permit charge to flow through the medium. Step 1120 is followed by step 1130, or by optional step 1125.

In optional step 1125, the selected region of the semiporous recording medium is dried to a moisture content not to exceed that of the recording medium equilibrated to 20% RH before depositing the charged fluid. Drying the recording medium can provide increased confinement of charge within the fluid drops, so that charge is still spatially patterned even as the drops spread through the recording medium. Example relationships between moisture content and resistivity are discussed above with reference to FIGS. 9 and 10. Drying can be performed by applying infrared or RF (e.g., microwave) radiation or hot air. The recording medium can also be passed through a dehumidifier or low-RH chamber, or passed through a nip including a heated roller. The recording medium can be dried by irradiation (e.g., infrared, ultraviolet), heating (e.g., hot-air application), desiccation (e.g., using a dehumidifier or vacuum chamber), or other ways, either with or without direct mechanical contact with the recording medium. Step 1125 is followed by step 1130.

In step 1130, charged fluid is deposited in a selected charged-fluid pattern on the selected region of the recording medium. This can be done, e.g., within 15 seconds after the completion of discharging or drying, or within a longer period of time. The charged-fluid pattern corresponds to the received image data, whether positive (CAD) or negative (DAD). For example, to print a black circle using black dry ink, in a CAD process the charged-fluid pattern will cover the area on the page to be occupied by that circle. In a DAD process, the charged-fluid pattern will cover the whole page except the area to be occupied by the circle.

The fluid can be clear, transparent, non-pigmented, or otherwise not substantially visible to the unaided human eye. The fluid can be a liquid or an ionized gas. Charged gasses can be deposited using an electrospray head with electrodes inside the nozzles, e.g., as described in Labowsky et al., U.S. Pat. No. 4,531,056; Fenn et al., U.S. Pat. No. 4,542,293; Henion et al., U.S. Pat. No. 4,861,988, Smith et al., U.S. Pat. Nos. 4,842,701 and 4,885,076; and Whitehouse et al., U.S. Pat. No. 5,306,412; all of which are incorporated herein by reference.

The charged fluid can be a hydrophilic liquid and the recording medium a semiporous recording medium. Alternatively, the charged fluid can be a hydrophobic liquid capable of being charged, and the recording medium can be a porous hydrophobic recording medium. For example, the fluid can be a fluid as described in "Hydrophobic, Highly Conductive Ambient-Temperature Molten Salts" by Bonhôte et al., *Inorg. Chem.,* 1996, 35 (5), pp. 1168-1178 (DOI 10.1021/ic951325x), incorporated herein by reference. The medium can include a top layer of porous hydrophobic material such as a fluorinated polymer. Examples are given in U.S. Patent Publication No. 2008/0125857, incorporated herein by reference. Step 1130 is followed by step 1140 and can include optional step 1135. Alternatively, the charged fluid can be a dielectric liquid such as ISOPAR, in which case the charge electrodes (described above with respect to FIG. 3) are driven so that a strong field gradient exits across the break-off site to separate the halves of the polar molecule from each other to form the charged drops.

In optional step 1135, depositing-fluid step 1130 includes providing a plurality of liquid drops moving towards the recording medium and electrostatically charging at least some of the liquid drops while they move. This is discussed further below. Step 1135 can include separating the liquid drops spatially or temporally during deposition so that the deposited charged-fluid pattern on the selected region of the recording medium includes spaced-apart liquid regions, each liquid region corresponding to one of the liquid drops. The recording medium can be dry between the spaced-apart liquid regions.

In step 1140, charged dry ink is deposited onto the recording medium. Dry ink can be deposited using an electrophotographic toning station such as toning station 623 (FIG. 6), but toning directly on to recording medium 32 carrying the charged-fluid pattern rather than toning on to photoreceptor 625 (FIG. 6). In a DAD process, the dry ink has charge of the same sign as the charge in the deposited charged-fluid pattern, so that the deposited dry ink is repelled by the charged-fluid pattern and adheres to the recording medium outside (which can include within areas enclosed by) the charged-fluid pattern. In a CAD process, the dry ink has charge of the opposite sign as the charge in the deposited charged-fluid pattern, so that the deposited dry ink is attracted to the charged-fluid pattern and adheres to the recording medium in or within the charged-fluid pattern, within tolerances for overlap or overrun (and likewise throughout).

"Dry ink" can include toner, various kinds and compositions of dry ink, or other materials that will hold a charge, including dry dyes. Dry dies can be prepared for use by drying them, breaking up the resulting agglomeration into many pieces, and loading the broken agglomeration in a printer. In a DAD process, the dry ink can be at least partly hydrophobic to reduce adhesion of the dry ink to the charged-fluid pattern. In a CAD process, the dry ink can be at least partly hydrophilic to increase adhesion of the dry ink to the charged-fluid pattern.

Step 1140 can follow quickly enough after step 1130 that the charge in the charged-fluid pattern has not migrated unacceptably far from the locations in which it was deposited. In a CAD process, the time between steps 1130 and 1140 is selected so that the deposited dry ink does not neutralize too much of the deposited charge, or else the dry ink will be less-strongly held to the recording medium. In a DAD process, step 1140 can optionally be followed by discharging the recording medium. For example, a grounded fixing roller can be used in step 1150. Step 1140 is followed by step 1150.

In step 1150, the deposited dry ink is fixed to the recording medium. Fixing can be performed by applying heat and pressure, chemicals, or radiation, as discussed above with respect to fuser 660 (FIG. 6). Fixing step 1150 can include a drying step before, during, or after fixing to reduce the moisture content of the recording medium. In an aspect, the fixing step includes passing the recording medium through a heated fusing nip. While in the fusing nip, the dry ink is heated above its glass transition temperature so that it adheres to the recording medium. The heat also heats the recording medium so that some or substantially all of the water absorbed therein boils away, drying the recording medium.

Figure 12:
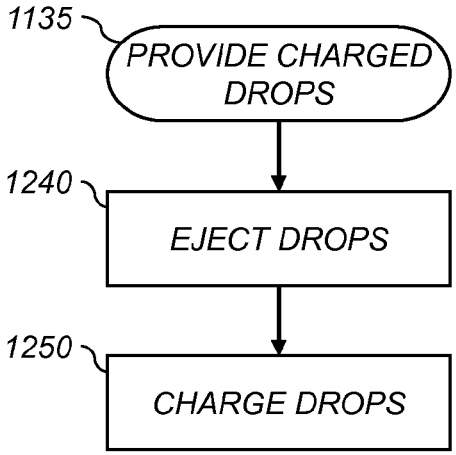
FIGS. 12 and 13 show details of various ways of providing charged drops.

FIG. 12 shows details of various ways of providing charged drops (step 1135, FIG. 11). Processing begins with step 1240.

In step 1240, the liquid drops are ejected from a drop-on-demand inkjet printhead, such as a thermal or piezoelectric head. Examples of drop-on-demand inkjet printers are discussed above with respect to FIGS. 4 and 5. Step 1240 is followed by step 1250.

In step 1250, substantially all of the liquid drops are electrostatically charged while they move, as described above. In an aspect, at least 90% of the ejected drops are charged. Not all drops are required to be charged since some drops can travel paths other than directly towards the receiver past the charge electrode. However, all drops can be charged if desired.

In these aspects, drops can be charged during or immediately after ejection, as described above. For example, as shown in FIG. 4, the charge electrode (electrode 44) can be driven to a particular voltage (step 1250), then the drop can be ejected (step 1240). As the drop forms, it will come under the influence of the electric field from the charging electrode. As a result, when the drop breaks off the bulk of the liquid in the chamber, it will carry a charge.

Figure 13:
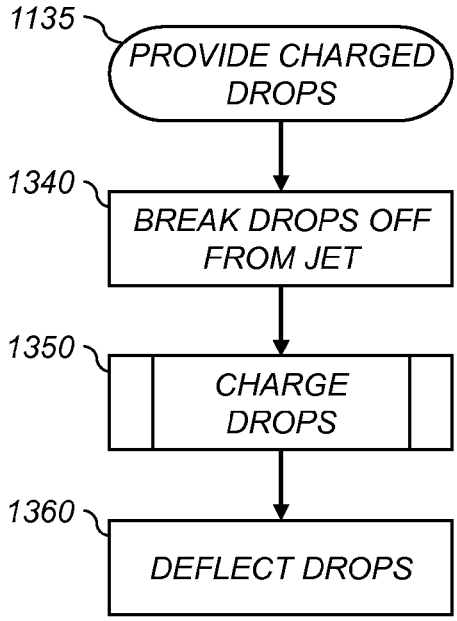

FIG. 13 shows details of various ways of providing charged drops (step 1135, FIG. 11). Processing begins with step 1340.

In step 1340, which is a break-off step, a liquid jet is ejected through a nozzle. While being ejected, the jet is heated according to a time-varying heating sequence so that successive portions of the jet break off into the liquid drops. Examples of this process are discussed above with respect to FIG. 2. Step 1340 is followed by step 1350.

In step 1350, which is a charging step, a selected charge state is provided to each liquid drop in response to the negative image data (for DAD; positive image data for CAD). One charge state that can be provided is a selected non-deposition charge state. Drops with the non-deposition charge state will not reach the recording medium. These drops correspond to areas on the recording medium where dry ink will adhere, for DAD, or will not adhere, for CAD. Another charge state that can be provided is a negative-image charge state (for DAD; an image charge state for CAD), which can have charge of the opposite sign as the charge in the non-deposition charge state. Examples of ways of charging are discussed below. Step 1350 is followed by step 1360.

In step 1360, which is a deflecting step, the liquid drops are selectively caused to travel along respective paths depending on their respective charge states. Drops with the same charge state generally travel the same or parallel paths, but each drop can take a different path. The respective paths are selected so that the liquid drops having the negative-image charge state (for DAD; the image charge state for CAD) are deposited onto the recording medium. Liquid drops having the non-deposition charge state are not deposited onto the recording medium. Drops not deposited on the recording medium can be caught and recirculated, as discussed above with respect to FIG. 3, or can be caught on a sponge such as that commonly found in a drop-on-demand inkjet printer's cleaning station. The deflected drops can strike recording medium 32, as shown in FIG. 3, or the undeflected drops (provided they are charged) can strike recording medium 32 and the deflected drops can be caught. Drops can be deflected by deflection electrodes, as shown in FIG. 3.

In a DAD system, liquid drops with the negative-image charge state strike the recording medium. Dry ink with the same sign of charge as the negative-image charge state (whether that charge is + or −) is applied to the recording medium (step 1140, FIG. 11). The dry ink is repelled from the charge of the applied drops. The result is that, in a DAD process, dry ink forms an image where the liquid drops are not deposited.

In a CAD system, liquid drops with the image charge state strike the recording medium. Dry ink with charge of the sign opposite that of the image charge state is attracted to the charge on the drops. In a CAD process, therefore, dry ink forms an image where the liquid drops are deposited.

Figure 14:
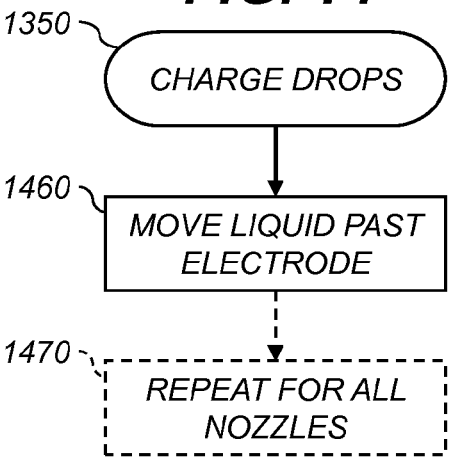
FIGS. 14 and 15 show details of various ways of charging drops.

FIG. 14 shows details of various ways of charging drops (step 1350, FIG. 13). A single charge electrode is used, e.g., as shown in FIG. 2. However, unlike in FIG. 2, voltage source 51 (FIG. 2) provides a constant DC bias to electrode 44 (FIG. 2), or provides a bias that has a consistent level for the break-off of each drop. Processing begins with step 1460.

In step 1460, the liquid of the jet (before break-off) or the drops (at or after break-off) is moved past a charge electrode driven at a selected potential. The time-varying heating sequence that causes drop break off, and the selected potential, are selected in response to the negative image data (for DAD; image data for CAD) so that the negative-image charge state (for DAD; image charge state for CAD) is provided to liquid drops that break of from the jet adjacent to, i.e., in operative proximity to, the charge electrode. Using standard engineering techniques, the distance for "adjacency" can be co-optimized with the charge states' polarities and charge magnitudes and the voltage states and waveforms for ejection and charging. The heating sequence can be automatically selected by a controller, or can be programmed in during the design of the printer. The non-deposition charge state is provided to liquid drops that do not break off from the jet adjacent to the charge electrode. "Adjacent to the charge electrode" refers to drops that break off liquid jet 43 (FIG. 2) a selected distance from the nozzle plate. In an aspect using DAD, a drop that breaks off the jet adjacent to the charge electrode has a significant magnitude of charge. That drop is deflected, as shown in FIG. 3, and strikes the paper. The charge in the drop is transferred to the paper. The dry ink is then repelled by the charge. Drops that break off adjacent to the charge electrode are therefore negative-image drops (where dry ink will not be deposited). In this way, a DC voltage can be used to differentially charge drops. One charge state or level, e.g., measured as charge per unit mass (q/m), is imparted to a drop that breaks off adjacent to the electrode. A different charge state (e.g., q/m) is imparted to a drop that does not break off adjacent to the electrode. Deflection can be based on q/m. The time-varying heating sequence can be selected so that all or substantially all drops have substantially equal masses, in which case the charge q independently differentiates the charge states. Break off length can be varied, e.g., as described in U.S. Pat. No. 7,192,121 issued Mar. 20, 2007 and U.S. Pat. No. 3,596,275, issued Jul. 27, 1971; both of which are incorporated herein by reference. The break-off length of the drops can be adjusted by varying the energy and pulse width of the waveform applied to the drop formation transducer (e.g., transducer 42, FIG. 2).

In various aspects using two charge electrodes spaced apart along the path of travel of the drops, the negative-image and non-deposition charge states can be adjusted independently, and one of them assigned to a particular drop by adjusting the break-off length of that drop. Step 1460 can be followed by optional step 1470.

In step 1470, the providing-liquid-drops step can include repeating the break-off, charging, and deflecting steps for each of a plurality of nozzles to provide respective pluralities of the liquid drops. The providing-liquid-drops step can include ejecting a plurality of liquid jets through respective nozzles and simultaneously heating the liquid jets according to respective time-varying heating sequences so that successive portions of the jets break off into the liquid drops, and the charging step can include moving the liquids of the jets or the drops from each of the nozzles past the charge electrode.

Figure 15:
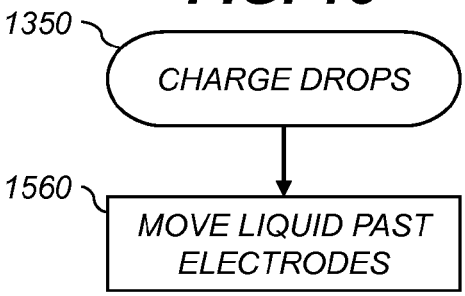

FIG. 15 shows details of various ways of charging drops (step 1350, FIG. 13). Two charge electrodes are used, as will be discussed below with reference to FIG. 16. Processing begins with step 1560.

In step 1560, the liquid of the jet or the drops is moved successively past two charge electrodes driven at respective potentials. The time-varying heating sequence and respective potentials are selected so that the negative-image (for DAD; image for CAD) charge state is provided to liquid drops that break off from the jet adjacent to one of the charge electrodes and the non-deposition charge state is provided to liquid drops that break off from the jet adjacent to the other of the charge electrodes.

Figure 16:
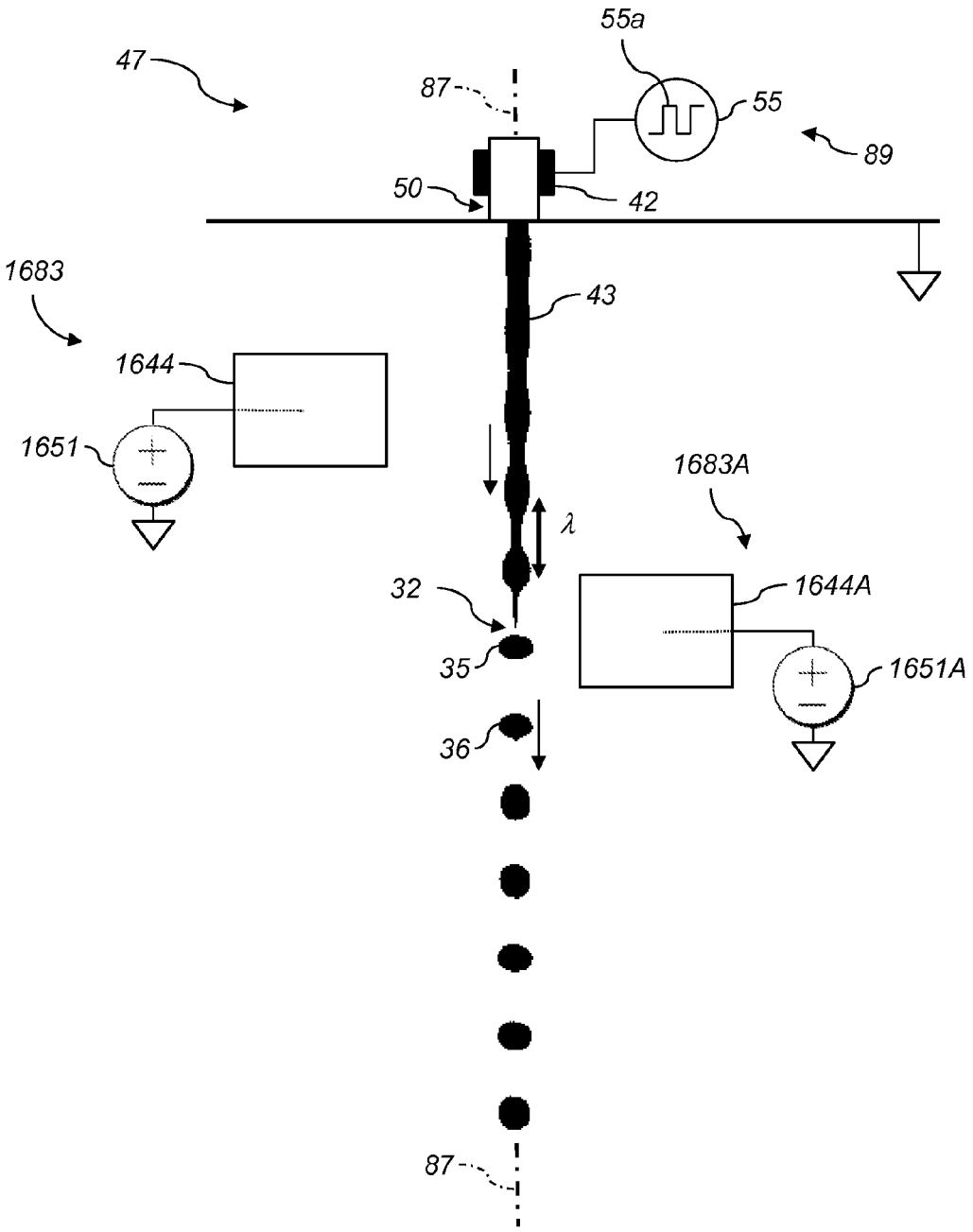
FIG. 16 shows a drop generator for a continuous inkjet printer, and a liquid jet being ejected from the drop generator and its subsequent break-off into drops.

FIG. 16 shows a drop generator for a continuous inkjet printer, and a liquid jet being ejected from the drop generator and its subsequent break-off into drops. Drops 35, 36, drop formation device transducer 42, liquid jet 43, nozzle 50, liquid jet axis 87, and drop formation device 89 are as shown in FIG. 2. Charging device 1683 includes charging voltage source 1651 that provides a DC bias (e.g., a fixed voltage, or ground) to charge electrode 1644. Charging device 1683A includes charging voltage source 1651A that provides a DC bias (e.g., a fixed voltage, or ground) to charge electrode 1644A. The respective biases provided by sources 1651, 1651A can be different.

In this example, drop 35 is breaking off jet 43 past charge electrode 1644, but adjacent to charge electrode 1644A. As a result, drop 35 will not carry the charge that a drop 36 that broke off adjacent to electrode 1644 would have. Drop 35 will instead carry a charge corresponding to the voltage provided by source 1651A. If charging device 1683A were not present, drop 35 would be substantially uncharged at break-off.

Successive electrodes as shown here, individual electrodes as shown in FIG. 2, and directly-opposed electrodes as shown in FIG. 3 can be used in any combination.

Figure 17:
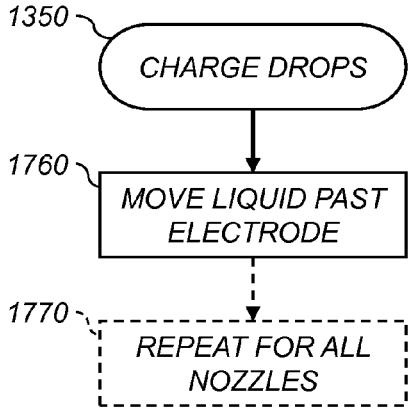
FIG. 17 shows details of various ways of charging drops.

FIG. 17 shows details of various ways of charging drops (step 1350, FIG. 13). One charge electrode is used, as is discussed above with reference to FIG. 2. Processing begins with step 1760.

In step 1760, the liquid of the jet or the drops is moved past a charge electrode connected to a source of varying electrical potential. The source provides an electrical waveform having distinct negative-image and non-deposition voltage states, e.g., the two states discussed above with reference to FIG. 2. The time-varying heating sequence, waveform, and voltage states are selected in response to the negative image data (for DAD; image data for CAD). The heating sequence of transducer 42 (FIG. 2) and the charging waveform can be automatically selected by a controller. Liquid drops that break off adjacent to the charge electrode while the source is providing the negative-image voltage state (for DAD; image voltage state for CAD) are given the negative-image charge state (for DAD; image charge state for CAD). The non-deposition charge state is provided to liquid drops that break off from the jet while the source is providing the non-deposition voltage state. Step 1760 is followed by step 1770.

In step 1770, the providing-liquid-drops step includes repeating the break-off, charging, and deflecting steps for each of a plurality of nozzles to provide respective pluralities of the liquid drops. A plurality of liquid jets can be ejected, simultaneously or not, through respective nozzles and heating the liquid jets heated during ejection according to respective time-varying heating sequences so that successive portions of the jets break off into the liquid drops. Moving step 1760 can include moving the liquids of the jet or the drops from each of the nozzles past the charge electrode.

Figure 18:
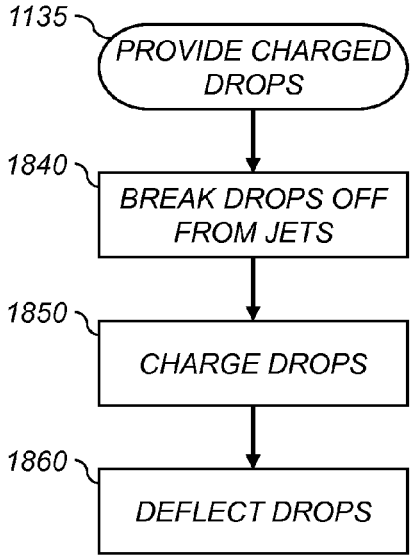
FIG. 18 shows details of various ways of providing charged drops.

FIG. 18 shows details of various ways of providing charged drops (step 1135, FIG. 11). Multiple charge electrodes are used, as will be discussed below with reference to FIG. 19. Processing begins with step 1840.

In step 1840, the providing-liquid-drops step includes ejecting a plurality of liquid jets through respective nozzles and simultaneously heating the liquid jets according to respective time-varying heating sequences so that successive portions of the jets break off into the liquid drops. Step 1840 is followed by step 1850.

In step 1850, the charging step includes moving the liquids of the jets or the drops from each of the nozzles past corresponding charge electrodes of a plurality of charge electrodes. Each charge electrode can be associated with one or more nozzles. Each charge electrode is connected to a respective source of varying electrical potential providing a respective waveform having distinct negative-image (for DAD; image for CAD) and non-deposition voltage states. The voltage states can be the same for each nozzle or different between nozzles.

The respective time-varying heating sequences, respective waveform, and respective voltage states are selected in response to the negative image data so that the liquid drops break off adjacent to the respective charge electrode. The negative-image (for DAD; image for CAD) charge state is provided to liquid drops that break off from the jet adjacent to the respective charge electrode while the respective source is providing the negative-image (for DAD; image for CAD) voltage state, and the non-deposition charge state is provided to liquid drops that break off from the jet while the respective source is providing the respective non-deposition voltage state.

In various aspects, the time-varying heating sequence is the same for each nozzle, and is not dependent on image data. The respective waveform for each nozzle's charge electrode is dependent on image data.

Other configurations described herein can also be used for each of multiple nozzles, including adjusting break-off length with respect to a single charging electrode or a pair of charging electrodes. Step 1850 is followed by step 1860.

In step 1860, the drops are deflected as described above with respect to step 1360 (FIG. 13). Deflection electrodes can be used, as shown in FIG. 3. A common deflection electrode or pair of deflection electrodes can be used for all the nozzles. Alternatively, a plurality of deflection electrodes or electrode pairs can be used, each for at least one nozzle but less than all the nozzles.

Figure 19:
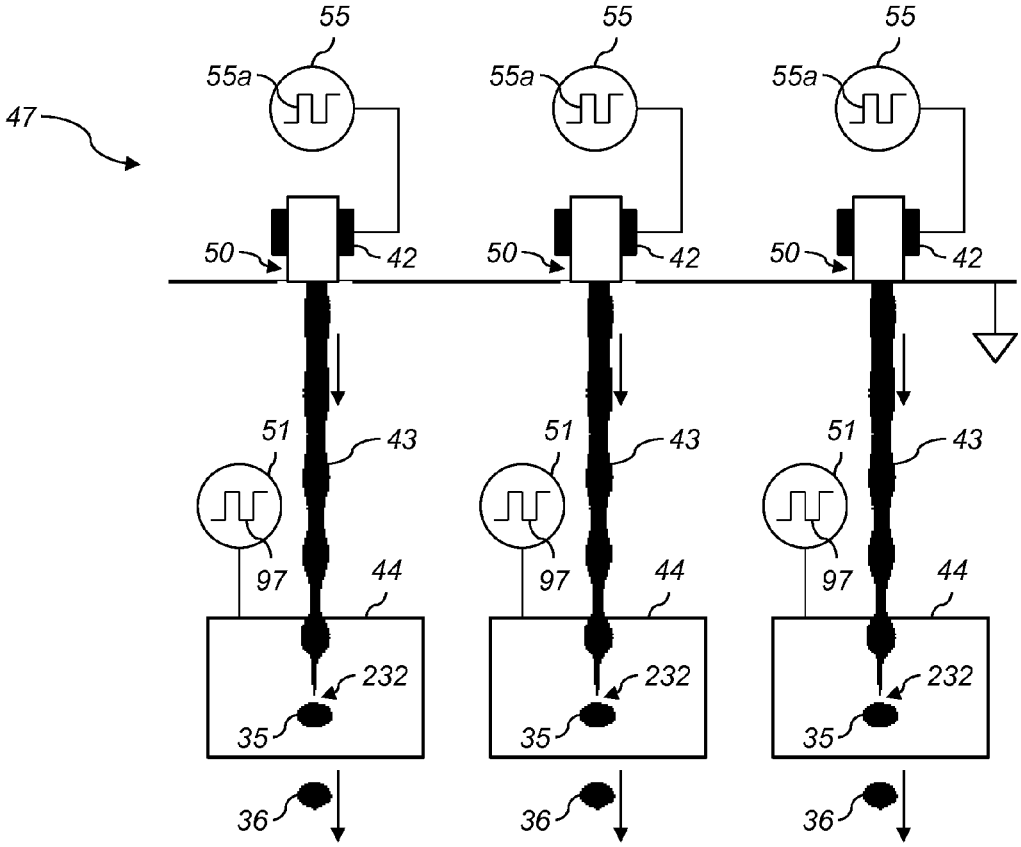
FIG. 19 shows a multi-nozzle drop generator for a continuous inkjet printer, and liquid jets being ejected from the nozzles and the jets' subsequent break-off into drops.

FIG. 19 shows a multi-nozzle drop generator for a continuous inkjet printer, and liquid jets being ejected from the nozzles and the jets' subsequent break-off into drops. Each nozzle 50 has associated with it a respective drop formation device transducer 42 driven by drop formation waveform source 55 producing waveform 55*a* to produce a respective jet 43. Each jet 43 passes by a respective charge electrode 44 at break-off location 232, where drops 35, 36 are formed.

Figure 20:
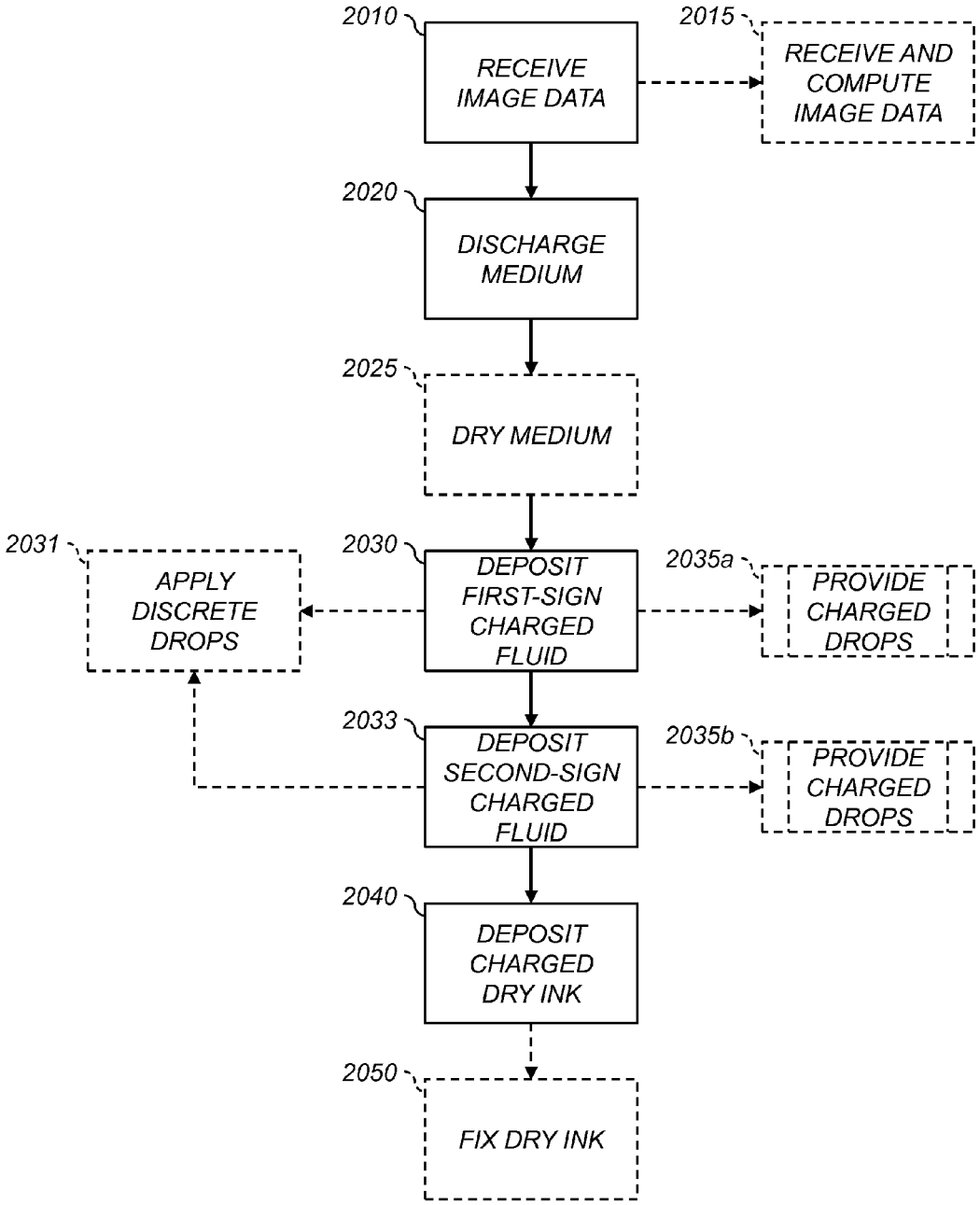
FIG. 20 shows methods of producing a print on a recording medium.

FIG. 20 shows methods of producing a print on a recording medium. Processing begins with step 2010.

In step 2010, positive and negative image data for the print to be produced are received. For example, in a monochrome image, the positive image data can represent regions on the recording medium where black dry ink is to be deposited, and the negative image data can represent regions on the recording medium where black dry ink is not to be deposited. The positive image data and negative image data can together cover the whole printing surface of the recording medium, or not. In an aspect, the positive and negative image data are provided together as a matrix of bits, 1 for a positive engine pixel and 0 for a negative engine pixel. Step 2010 is followed by step 2020 and can include optional step 2015.

In optional step 2015, positive (negative) image data are received from a data source, e.g., a hard drive, digital front end, or network. A processor automatically computes the negative (positive) image data from the received positive (negative) image data.

In step 2020, a selected region of the recording medium is discharged, e.g., as discussed above with reference to step 1120 (FIG. 11). Step 2020 is followed by step 2030 or optional step 2025.

In optional step 2025, the selected region of the recording medium is dried to a moisture content not to exceed that of the recording medium equilibrated to 20% RH before depositing either the first-sign charged fluid or the second-sign charged fluid. Step 2025 is followed by step 2030.

In step 2030, first-sign charged fluid is deposited in a selected first-sign charged-fluid pattern on the selected region of the recording medium. This can be done, e.g., within 15 seconds after the completion of discharging (step 1120) or drying (step 1125). The first-sign charged-fluid pattern corresponds to the positive image data. The fluid can be deposited, e.g., as discussed above with reference to step 1130 (FIG. 11). The first sign can be either + or −. Step 2030 is followed by step 2033 and can include optional steps 2031 or 2035*a*.

In step 2031, each depositing-fluid step includes applying discrete drops of the corresponding fluid to spaced-apart drop locations on the recording medium. The recording medium and the first- and second-sign charged fluids are selected so that the applied drops do not merge, i.e., come into contact with each other by spreading through the medium, before the dry ink is deposited.

In step 2035*a*, the charged drops are provided. This is discussed below with reference to step 2035*b*.

In step 2033, second-sign charged fluid is deposited in a selected second-sign charged-fluid pattern on the selected region of the recording medium. The second-sign charged-fluid pattern corresponds to the negative image data, and the second sign is different from the first sign. Steps 2030 and 2033 can be performed simultaneously, or in either order. Fluid patterns with two different signs of charge can be deposited by one printhead by adjusting the electrode voltage states and timing. For example, charging electrode 44 (FIG. 19) can be driven to alternate between +200V and −200V. Drops that break off in the +200V state will have a negative charge, and drops that break off in the −200 V state will have a positive charge. (Electrode 44 can also be driven to alternate between +200V and approximately +100V to produce substantially-negatively charged drops and electrostatically neutral drops.) The first- and second-sign charged fluids can be hydrophilic liquids and the recording medium can be a semiporous recording medium. Alternatively, the first- and second-sign charged fluids can be hydrophobic liquids and the recording medium can be a porous hydrophobic recording medium, as discussed above with reference to step 1130 (FIG. 11). Step 2033 is followed by step 2040 and can include optional steps 2035*a* or 2035*b*.

In steps 2035*a*, 2035*b*, each depositing-fluid step 2030, 2033 includes a respective dropping step 2035*a*, 2035*b* of providing a plurality of liquid drops moving towards the recording medium and electrostatically charging the liquid drops while they move. Dropping step 2035*a* of first-sign-charged-fluid-depositing step 2030 provides liquid drops corresponding to the positive image data, and dropping step 2035*b* of second-sign-charged-fluid-depositing step 2035 provides liquid drops corresponding to the negative image data. This can be done various ways, as described below with reference to FIG. 21. For clarity, the discussion below refers to "step 2035", which signifies steps 2035*a* or 2035*b*.

In step 2040, charged dry ink having charge of the second sign is deposited onto the recording medium. The deposited dry ink is attracted to the (oppositely-charged) first-sign charged-fluid pattern and adheres to the recording medium in the first-sign charged-fluid pattern (or within the pattern, including overlap or overrun if they occur). Step 2040 can be followed by optional step 2050.

In optional step 2050, the deposited dry ink is fixed to the recording medium, e.g., as discussed above with reference to step 1150 (FIG. 11).

Each dropping step 2035*a*, 2035*b* can include providing the liquid drops by ejecting the liquid drops from a drop-on-demand inkjet printhead, e.g., a thermal or piezoelectric head. This is as described above with reference to FIG. 12.

Figure 21:
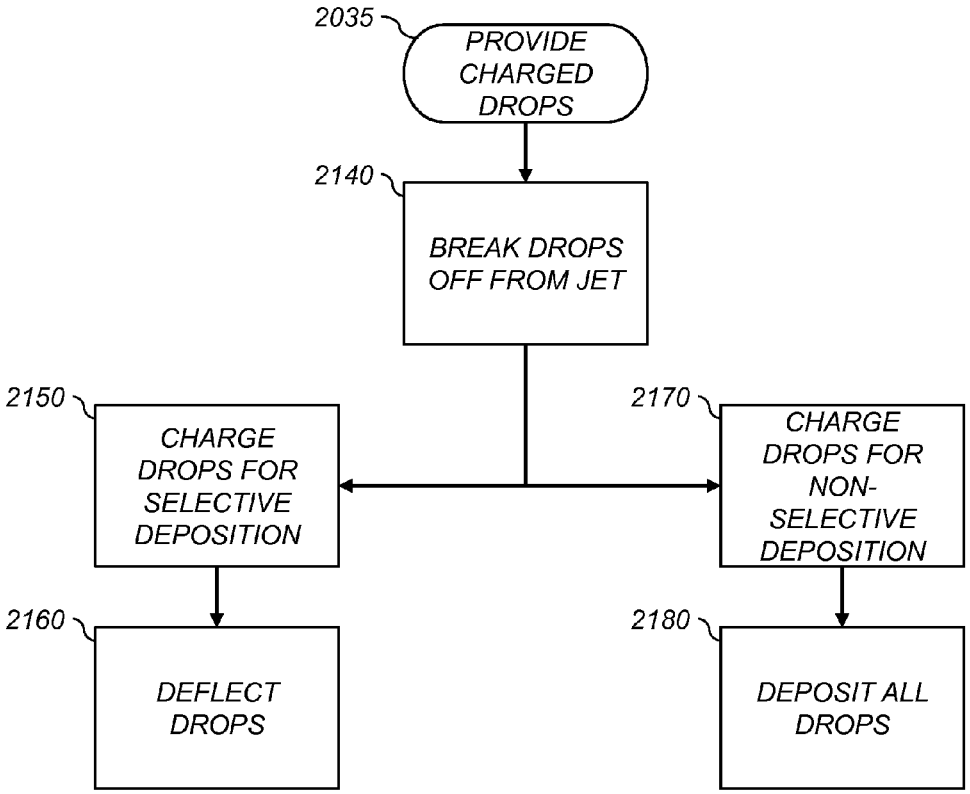
FIG. 21 shows details of various ways of providing charged drops.

FIG. 21 shows details of various ways of providing charged drops (step 2035, FIG. 20). Processing begins with step 2140.

In step 2140, which is a break-off step, a liquid jet is ejected through a nozzle. While being ejected, the jet is heated according to a time-varying heating sequence so that successive portions of the jet break off into the liquid drops. Examples of this process are discussed above with respect to FIGS. 2 and 3. Step 2140 is followed by either step 2150 or step 2170.

In step 2150, which is a charging step, a selected charge state is provided to each liquid drop in response to the image data corresponding to the deposition in question (step 2030 of FIG. 20, positive image data; step 2033 of FIG. 20, negative image data). Either a selected non-deposition charge state or a selected deposition charge state is provided to each liquid drop. The non-deposition charge state is imparted to drops that, whether the image data are positive or negative, will not strike recording medium 32. The deposition state is imparted to drops that will strike recording medium 32. Step 2150 is followed by step 2160.

In step 2160, which is a deflecting step, the liquid drops are selectively caused to travel along respective paths depending on their respective charge states. Drops with the same charge state generally travel the same or parallel paths, but each drop can take a different path. The respective paths are selected so that the liquid drops having the deposition charge state are deposited onto the recording medium. Liquid drops having the non-deposition charge state are not deposited onto the recording medium. Drops not deposited on the recording medium can be caught and recirculated, as discussed above with respect to FIG. 3, or can be caught on a sponge such as that commonly found in a drop-on-demand inkjet printer's cleaning station. Liquid drops having the respective deposition charge state are deposited onto the recording medium and liquid drops having the respective non-deposition charge state are not deposited onto the recording medium.

Alternatively, in step 2170, which is a charging step, a selected charge state is provided to each liquid drop in response to the image data corresponding to the deposition in question (step 2030 of FIG. 20, positive image data; step 2033 of FIG. 20, negative image data). Either a selected image charge state or a selected negative-image charge state is provided to each liquid drop. The image charge state is imparted to drops that, whether the image data are positive or negative, will attract dry ink. The negative-image charge state is imparted to drops that will repel dry ink. Step 2170 is followed by step 2180.

In step 2180, which is a depositing step, substantially all of the liquid drops are permitted to strike the recording medium. The drops deposit their respective charges to form a charge pattern on the recording medium that attracts dry ink where it should be (according to the image data) and repels it from where it should not be. This can be performed without deflecting drops.

Other ways described above of charging drops can also be used. In various aspects, each dropping step 2035 further includes moving the liquid of the jet or the drops past a charge electrode driven at a respective selected potential, as described above with reference to FIG. 14. The time-varying heating sequence and respective selected potentials are selected so that one state of the respective deposition charge state and the respective non-deposition charge state is provided to liquid drops that break off from the jet adjacent to the charge electrode and the other state of those states is provided to liquid drops that do not break off from the jet adjacent to the charge electrode.

In various aspects, each dropping step further includes moving the liquid of the jet or the drops past a charge electrode connected to a source of varying electrical potential, e.g., as described above with reference to FIG. 17. The source provides a waveform having respective distinct deposition and non-deposition voltage states. The time-varying heating sequence, waveform, and respective voltage states are selected so that the respective deposition charge state is provided to liquid drops that break off from the jet adjacent to the charge electrode while the source is providing the respective deposition voltage state and the respective non-deposition charge state is provided to liquid drops that do not break off from the jet adjacent to the charge electrode while the source is providing the respective non-deposition voltage state.

In various aspects, the liquid drops are provided from a plurality of nozzles, each providing a respective jet. This is described above with reference to FIGS. 18 and 19. Each dropping step further includes moving the liquids of the jets or the drops from each nozzle past a charge electrode corresponding to the nozzle. Each charge electrode is connected to a respective source of varying electrical potential providing a waveform having respective first and second distinct voltage states. The time-varying heating sequence, waveform, and respective voltage states are selected so that one state of the respective print charge state and the respective non-print charge state is provided to liquid drops that break off from the corresponding jet adjacent to the corresponding charge electrode while the respective source is providing the respective first voltage state and the other state of those states is provided to liquid drops that do not break off from the corresponding jet adjacent to the corresponding charge electrode while the respective source is providing the second voltage state.

In various aspects, each dropping step includes separating the liquid drops spatially or temporally so that the deposited first-sign and second-sign charged-fluid patterns on the selected region of the recording medium include spaced-apart liquid regions, each corresponding to one of the liquid drops. The regions can have dry paper between them.

In various aspects, the depositing-fluid steps are performed by a break-off step of ejecting a jet of a fluid through a nozzle and simultaneously heating the liquid jet according to a time-varying heating sequence so that successive portions of the jet break off into liquid drops. The liquid of the jet or the drops is moved successively past two charge electrodes driven at respective potentials, as described above with reference to FIGS. 15 and 16. The time-varying heating sequence and respective potentials are selected so that the first sign of charge is provided to liquid drops that break off from the jet adjacent to one of the charge electrodes and the second sign of charge is provided to liquid drops that break off from the jet adjacent to the other of the charge electrodes. The first-sign charged fluid includes the liquid drops with the first sign of charge and the second-sign charged fluid includes the liquid drops with the second sign of charge.

Figure 22:
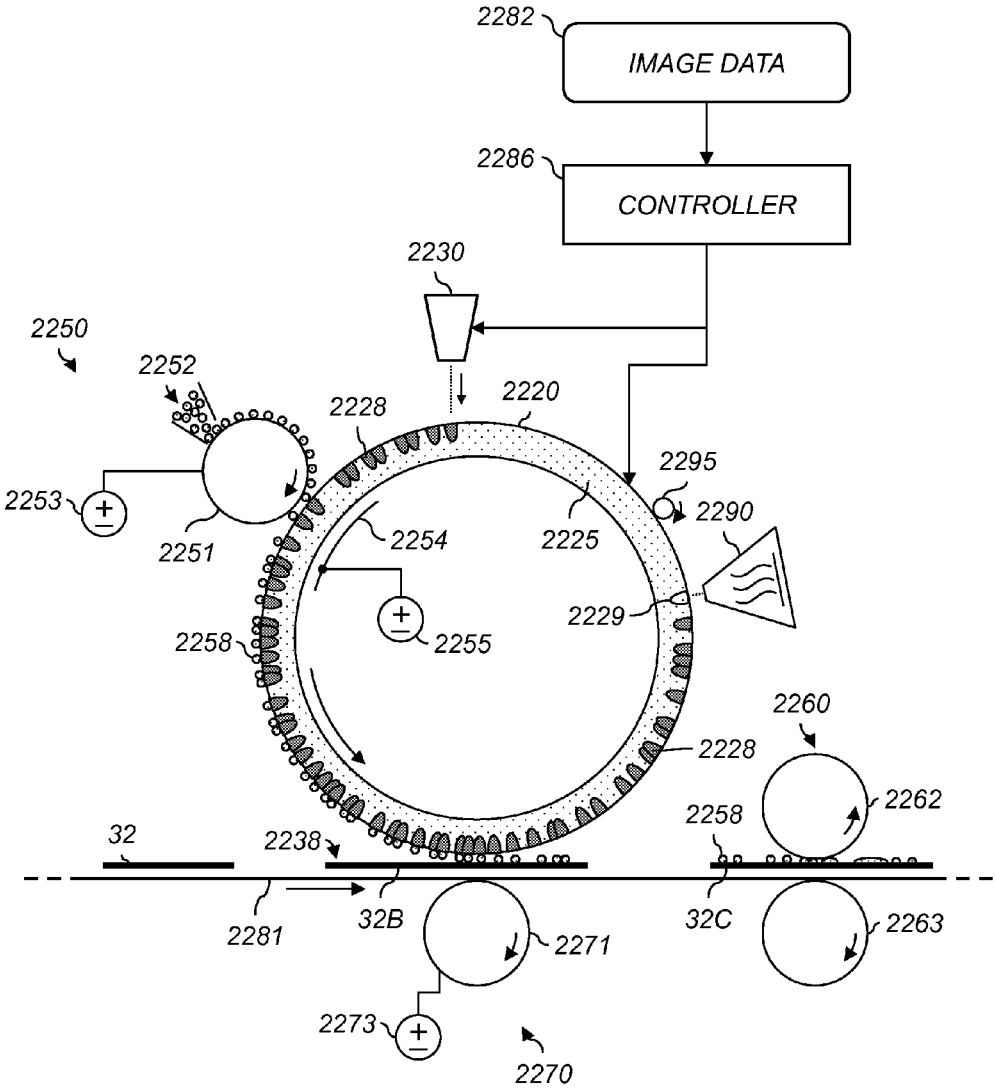
FIGS. 22-23 are schematics of apparatuses for producing prints on recording media.

FIG. 22 is a schematic of apparatus for producing a print on recording medium 32. Unlike the electrophotographic printer shown in FIG. 6, this apparatus does not use photoreceptor 625 (FIG. 6) or other photosensitive imaging member to control where dry ink is deposited on recording medium 32. The data path shown in FIG. 7 can be used with this printer. Recording medium 32 can be a nonporous recording medium.

A transport (not shown) moves recording medium 32 along a transport path (not shown). In the aspects shown, the transport includes transport belt 2281. The transport can also include a drum, stage, or other device for moving recording medium 32. Recording medium 32 can be a sheet or web, and can be paper or other media types. Intermediate member 2220 and fixing device 2260 are arranged in that order along the transport path.

Rotatable intermediate member 2220 can be a drum (as shown) or belt. Printhead 2230, development station 2250, transfer station 2270, and optional dryer 2290 are arranged in that order along the rotation of intermediate member 2220.

Printhead 2230 provides drops of charged fluid to intermediate member 2220. Printhead 2230 can be an inkjet printhead, e.g., a drop-on-demand or continuous printhead, operating thermally or piezoelectrically. Intermediate member 2220 receives drops 2228 of charged fluid, represented graphically as hatched semi-ellipses. For clarity, not all drops 2228 are labeled. Drops 2228 are shown corresponding to dry ink particles 2258, but drops 2228 and dry ink particles 2258 are not necessarily shown at the same scale. Controller 2286 receives image data 2282 (e.g., screened pixel levels 760 of FIG. 7). Controller 2286 can include a microcontroller, microprocessor, or other components described herein. Controller 2286 controls printhead 2230 and intermediate member 2220 so that a charged-fluid pattern corresponding to the image data is produced on intermediate member 2220. Image data 2282 can be positive image data or negative image data, as described above, e.g., with reference to FIG. 21. Consequently, the drops can be located at places on intermediate member 2220 where dry ink should be present, or should not be present. This is described above, e.g., with reference to step 1140 (FIG. 11). Controller 2286 can operate intermediate member 2220 to produce less than one line of output per revolution (olpr), one olpr, more than one olpr, a full page per revolution (ppr), or more than one ppr.

In various aspects, intermediate member 2220 includes drop retention layer 2225 that retains the received drops of charged fluid in position laterally with respect to intermediate member 2220. That is, drop retention layer 2225 retains the drops in their relative positions as deposited, even if intermediate member 2220 is moving. In the aspects shown, drop retention layer 2225 is at the surface of intermediate member 2220. Drop retention layer 2225 can be formed from a hydrophobic material having an open-cell structure, e.g., a Teflon foam. For example, the charged fluid can be a hydrophilic liquid and drop-retention layer 2225 can be semiporous. The charged fluid can also be a hydrophobic liquid, such as discussed above, and drop retention layer 2225 can be porous and hydrophobic. Drop retention layer 2225 can also include mesh, individual cups that can each hold one drop, or other fluid-retention features.

Development station 2250 applies charged dry ink to intermediate member 2220 bearing the charged-fluid pattern. As a result, a dry ink image corresponding to the image data is formed on intermediate member 2220. The dry ink image includes dry ink particles 2258, represented graphically as hatched circles. For clarity, not all particles are labeled. Biasable toning member 2251 and separately-biasable area electrode 2254 are arranged on opposite sides of a toning region. Area electrode 2254 can also be part of intermediate member 2220. For example, intermediate member 2220 can have a biased conductive core with drop retention layer 2225 arranged around it. The biases of toning member 2251 and area electrode 2254 are chosen so that the electric field between toning member 2251 and area electrode 2254 is strong enough to deposit dry ink onto any point of the toning region. The dry ink deposition is effected by electrical forces arising from the charge on the dry ink particles and the electric field between toning member 2251, area electrode 2254, and the charge pattern on intermediate member 2220. For example, with positively charged dry ink, the electric field can be oriented from toning member 2251 to area electrode 2254 to cause dry ink particles on toning member 2251 to fall down the electric field towards intermediate member 2220. The particles are deflected laterally by the charge in the charged-fluid pattern.

Voltage source 2253 applies a bias to toning member 2251. The bias is less than the potential of the charged areas of recording medium 32 and greater than the potential of the uncharged areas of recording medium 32. Biases and potentials can be measured with respect to the area electrode. The area electrode can be driven to a specific potential by voltage source 2255, or can be grounded.

Supply 2252 includes charged dry ink particles. Supply 2252 can include various components adapted to provide dry ink to the printer and charge the dry ink. In various aspects, supply 2252 includes a dry ink bottle (not shown), a gate for selectively dispensing metered amounts of dry ink from the bottle into a reservoir, and an auger in the reservoir for mixing the dry ink to tribocharge it. The charge of the dry ink can have the same sign as the charge in the charged-fluid pattern (DAD) or the opposite sign (CAD).

Transfer station 2270 transfers the dry ink image from intermediate member 2220 to dry ink side 2238 of recording medium 32B. This can be performed as discussed above with respect to transfer subsystem 650 (FIG. 6). Bias source 2273 can bias transfer backup roller 2271 to provide an electric field that draws the charged dry ink from intermediate member 2220 to recording medium 32B.

After being transferred to recording medium 32, the dry ink can optionally pass through fixing device 2260 that fixes the transferred dry ink image on recording medium 32C. In an aspect, fuser 660 (FIG. 6) is used as fixing device 2260. In various aspects, fixing device 2260 includes heated rotatable fixing member 2262 arranged to form a fixing nip with rotatable pressure member 2263, through which nip recording medium 32C passes.

After the dry ink is transferred off intermediate member 2220, member 2220 continues to rotate. In various aspects, the charged-fluid pattern passes by dryer 2290 as member 2220 rotates. Dryer 2290 removes the drops of charged fluid from drop-retention layer 2225 after the dry ink image is transferred to recording medium 32B. In the aspect shown, dryer 2290 is a hot-air blower and charged-fluid drop 2229 is evaporating as the hot air blows on it. In other aspects, dryer 2290 can draw vacuum, blow cold air, wipe a sponge over drop-retention layer 2225, or otherwise remove the charged-fluid drops from layer 2225. Optional discharger 2295 can neutralize any charge remaining on intermediate member 2220 after drying. Discharger 2295 can be a roller charger (as shown), a brush charger, a corona charger, or other types of charger or discharger.

Referring back to FIG. 3, in various aspects, printhead 2230 (FIG. 22) includes liquid chamber 24 in fluidic communication with nozzle 50. Liquid chamber 24 contains liquid under pressure sufficient to eject liquid jet 43 through nozzle 50. Drop formation device 89 associated with liquid jet 43 produces a modulation in liquid jet 43 to cause portions of liquid jet 43 to break off into a series of liquid drops 35, 36 traveling along a path (here, vertically downward). A charge electrode, here having portions 44*a*, 44*b*, is associated with liquid jet 43. Source 51 of electrical potential is connected to the charge electrode and imparts either a selected non-deposition charge state or a selected deposition charge state to each liquid drop 35, 36 in response to image data 2282 (FIG. 22). A deflector, here including electrodes 53, 63, selectively causes liquid drops 35, 36 to travel along respective paths 37, 38 depending on their respective charge states so that liquid drops 36 having the deposition charge state are deposited onto recording medium 32 and liquid drops 35 having the non-deposition charge state are not deposited onto recording medium 32.

Various aspects of charge electrodes described herein can be used. Two transducers, one to produce drops and one to modulate the velocity of the drops, can be used. Drops can be caused to break off adjacent or nonadjacent to a DC-driven electrode, or to break off adjacent to an AC-driven electrode or to one of a plurality of DC-driven electrodes. Piezoelectric ejection can also be used to form drops 35, 36 without breaking them off liquid jet 43. Printhead 2230 can include any number of nozzles 50, and the charge electrode and deflection electrode can be per-nozzle or common across multiple nozzles.

Figure 23:
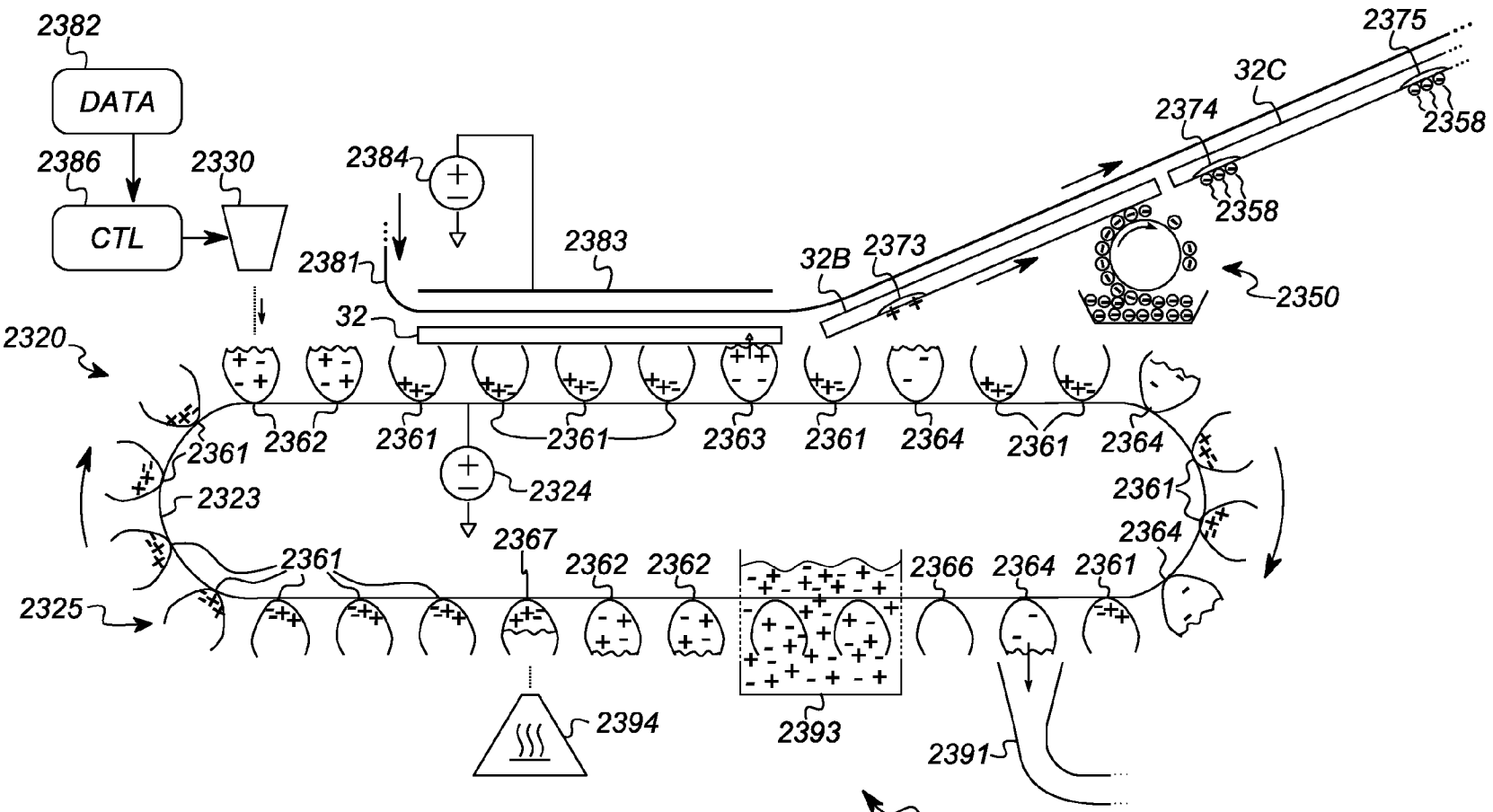

FIG. 23 shows apparatus for producing a print on a recording medium. Printhead 2330 provides drops of hydrophilic liquid, e.g., water. In these aspects, the hydrophilic liquid does not carry a charge of its own. Printhead 2330 can be a drop-on-demand inkjet printhead, thermal or piezoelectric, or a continuous-inkjet printhead using electrostatic, gas-flow, or other deflection strategies. Printhead 2330 can use electrostatic deflection as described above, e.g., with reference to FIG. 2, 3, or 16.

Intermediate member 2320 includes conductive element 2323, e.g., a layer or central core made from metal. Drop-retention layer 2325 is disposed over conductive element 2323 to receive the drops of hydrophilic liquid from printhead 2330. Drop-retention layer 2325 is formed from a hydrophobic material, e.g., PTFE, having a plurality of cells 2361, 2362, 2363, 2364, 2366, 2367. Layer 2325 can be, e.g., an open-cell foam, or an array of individual cups or wells (as shown), e.g., an array formed by a mesh. Liquid can be held in the cells by surface tension or capillary forces. At the point where liquid drops reach drop retention layer 2325, layer 2325 has an ion donor, e.g., a salt, acid, or base, disposed in one or more of the cells (here, cells 2361, 2362, 2363, 2364, 2366, 2367). Cells can be arranged in two dimensions in drop-retention layer 2325.

Controller 2386 receives image data 2382 for the print. Controller 2386 controls printhead 2330 and intermediate member 2320 (control connection not shown for clarity) so that a liquid pattern corresponding to image data 2382 is produced in cells 2362, 2363. That is, the liquid pattern covers multiple cells. The ion donor in the cells in the pattern (here, cells 2362, 2363) dissolves in the deposited liquid so that the liquid pattern includes ions having respective signs of charge. Controller 2386 and image data 2382 can be as described above with reference to FIG. 22.

Transport member 2381 brings recording medium 32 into contact with the liquid pattern on intermediate member 2320. In the aspect shown, recording medium 32 is in contact with the liquid in cell 2363, which is part of the liquid pattern. In other aspects (not shown), recording medium 32 is separated from the liquid pattern by a gap, and the ion-transfer electric field (described below) is strong enough to transportions across the gap but weak enough that neither recording medium 32 nor the gap undergoes dielectric breakdown during ion transport.

Backing electrode 2383 is arranged opposite positioned recording medium 32 from intermediate member 2320. Conductive element 2323 is connected to voltage supply 2324, and backing electrode 2383 is connected to voltage supply 2384. Either voltage supply 2324, 2384 can be a strap directly connecting the respective electrode 2323, 2383 to a particular voltage, e.g., ground. Either supply 2324, 2384 can be selectively enabled.

A voltage source, in this aspect composed of supplies 2324 and 2384, applies a bias across recording medium 32 in contact with the liquid pattern using backing electrode 2383 and conductive element 2323 of intermediate member 2320. This can be performed under the control of controller 2386. Under bias, at least some of the ions of a selected one of the signs of charge (here, +) move from the liquid pattern to (into or onto) recording medium 32. These ions carry their charge with them, so a charge pattern corresponding to the liquid pattern is thus developed on recording medium 32. An example of this is discussed below. In various aspects, the dielectric constant of the liquid (e.g., water at 20° C., $\in_r$=80.1) is higher than that of drop-retention layer 2325 (e.g., PTFE, $\in_r$=2.1). This concentrates the electric field between the intermediate member and the backing electrode in the higher-$\in_r$ areas, so the electric field strength at the surface of recording medium 32 is stronger in areas adjacent to the liquid pattern than in areas not adjacent to the liquid pattern.

Development station 2350 applies charged dry ink to recording medium 32B bearing the charge pattern, so that a dry ink image corresponding to the image data is formed on recording medium 32B. As shown, development station 2350 includes a rotating member that draws dry ink particles from a supply and brings them into proximity with recording medium 32B for electrostatic transfer. The dry ink can be charged to a sign opposite the selected one of the signs of charge (CAD) or to the same sign (DAD). Recording medium 32C is shown with dry ink thereon in a CAD system. Charged-fluid islands 2374, 2375 carry positive charge from the positive ions. Negatively-charged dry ink particles 2358 are held electrostatically to islands 2374, 2375 to form the dry ink image on recording medium 32C. The dry ink image can then be fixed as described above with reference to FIG. 6 or 22.

In this aspect, cells 2361 include an ion donor but no liquid. This is represented graphically as a cluster of positive (+) and negative (−) charges clustered at the bottom of each cell 2361. Cells 2362 are cells in which printhead 2330 has deposited hydrophobic liquid. The meniscus of the liquid is represented graphically as a wavy line. The ion donor has dissolved in the liquid, represented graphically by the + and − indications being spread out through cell 2362. In various aspects, the ion donor is a salt (e.g., a metallic salt), an acid (e.g., a mineral acid), or a base (e.g., a strong base). In various aspects, the ion donor is NaOH, LiOH, KOH, $H_3PO_4$, $(H_2PO_4)^-$, or $(HPO_4)^{2-}$.

Cell 2363 contains liquid and ion donor, and is exposed to the electric field between conductive element 2323 and backing electrode 2383. As a result, the positive ions (+) are being drawn towards recording medium 32, indicated graphically by the open-headed arrow. The negative ions (−) are being drawn away from recording medium 32. Since recording medium 32 is in contact with the liquid in cell 2363, the liquid wets recording medium 32 and carries the positive ions with it. This produces a charged-fluid island, e.g., charged-fluid island 2373 on recording medium 32B. Once the positive charge has left cell 2363, the result is a depleted cell, e.g., depleted cell 2364. Depleted cells contain liquid and only one sign of ion (here, negative). In various aspects, drop-retention layer 2325 is arranged so that the received liquid in cells 2363 is in mechanical contact with electrical element 2323. This is not required, however, since the electric field will still move the ions.

Continuing clockwise around intermediate member 2320, in this example, after the charge pattern is produced on recording medium 32, dryer 2391 removes the liquid pattern from depleted cells 2364 of drop-retention layer 2325. Dryer 2391 can remove the remaining ions from the cells or not. In this example, dryer 2391 is a vacuum that removes liquid and ions from depleted cells 2364. Dryer 2391 can also be a hot-air dryer or any other type of dryer described herein. The result is that the cells in drop-retention layer 2325 are emptied of some, substantially all, or all fluid or ions, resulting in empty cells 2366. However, as just mentioned, empty cells 2366 can contain residual fluid or ions.

In various aspects, dryer 2391 includes a source and electrodes (not shown) for applying an AC voltage to depleted cells 2364. This moves the remaining ions in depleted cells 2364 into an equilibrium position. Dryer 2391 then adds energy to depleted cells 2364 to evaporate the liquid, leaving the ions behind.

Since ions have been transferred to recording medium 32, in various aspects, ions are replenished into drop-retention layer 2325. In various aspects, the liquid pattern includes ions of two signs of charge. The applied bias moves at least some of the ions of a selected one of the two signs of charge into the recording medium, as described above. Replenisher 2392 adds ions of the selected one of the two signs of charge (here, +) to at least some of the cells of the liquid pattern after the charge pattern is formed on recording medium 32. Replenisher 2392 can include mechanical deposition of the ion donor, e.g., powder-cloud development of a salt into empty cells 2366. In the aspect shown here, replenisher 2392 includes container 2393 of an aqueous solution of the ion donor arranged so that the cells in drop-retention layer 2325 pass through container 2393. In an aspect, intermediate member 2320 is a belt threaded to dip into container 2393. Multiple containers 2393 can also be used.

In various aspects, replenisher 2392 deposits ion donor in drop-retention layer 2325 after the liquid pattern is removed by dryer 2391. After container 2393, dryer 2394 (e.g., a hot-air dryer) removes the liquid without removing the ions. Cell 2367 is shown in the process of being dried; its ion donor is being concentrated in the bottom of cell 2367. The result is cells 2361 that are ready to receive fluid. In this aspect, two dryers 2391, 2394 are used. However, a single dryer can be used, either before or after container 2393.

In an aspect using multiple containers 2393, dryer 2391 is not used. Depleted cells 2364, still containing fluid, are passed through a first container 2393 that includes a concentrated aqueous solution of the ion donor. As cells 2364 pass through the first container 2393, ions of the depleted charge sign (here, +) flow down their concentration gradient into cells 2364. However, a single container cannot raise the concentration of ions in cells 2364 to the original desired concentration (referred to herein as 100%), since the fluid in the container loses ions as the cells receive ions. Multiple successive baths of 100% ion donor solution can be used to raise the concentration in depleted cells 2364 to an acceptable level, at which point they are cells 2362.

In various aspects, the ion donor is a mineral salt, e.g., LiOH or KOH. The negatively-charged hydroxyl groups ($OH^-$) are transferred to recording medium 32. Replenisher 2392 adds hydroxyl groups; in various aspects, replenisher 2392 does not add more minerals (e.g., Li). In other aspects, the ion donor is phosphoric acid, which can donate three $H^+$ ions (protons) to an aqueous solution. These protons are transferred to recording medium 32.

Various configurations and ways of producing prints have been described herein. Specific examples of some of those ways are described below.

Referring back to FIG. 2, in an AC-driven common-electrode configuration, drops 35, 36 are formed separated in time by the fundamental period $T_o$ (on average). Drop formation waveform 55*a* is image-dependent. Charging waveform 97 is image-independent and has two voltage states: a high-charge state and a low-charge state. The period of waveform 97 is substantially equal to the fundamental period $T_o$. The energy and timing of the pulses in waveform 55*a* are adjusted to control the timing of the drop break-off so that break-off occurs during either the high-charge or the low-charge voltage state depending on the image data. All of the drops (within tolerances) are caused to break off adjacent to the electrode at break-off location 232.

Specifically, one drop is created in every fundamental period. This causes the size of the drops to be similar. Since a common electrode is used, in any fundamental period, the electrode may need to induce both charge states on respective drops, not just one charge state per period. Therefore, the charge-electrode waveform has both charge states during each fundamental period: one for image (or negative-image), and one for non-deposition. The timing of the break-off pulse from the drop formation transducer is adjusted to cause the drop to break off either during the first voltage state or the second voltage state, dependent on the image data.

Break-off can be synchronized with waveform 97 by adding a constant phase delay between clocks of the drop formation waveform source 55 and charging voltage source 51 so that the drops break off during the proper charge electrode waveform voltage state. In a DAD system, the high-charge voltage state produces drops having the negative-image charge state, and the low-charge voltage state produces drops having the non-deflection charge state. In a CAD system, high-charge corresponds to the image charge state. Highly-charged drops are deflected and strike the recording medium.

Referring back to FIG. 16, in a DC-driven common-electrode configuration, drops are formed separated in time by the fundamental period (on average). Drop formation waveform 55*a* is image-dependent. Charging voltage source 1651 applies a DC bias to electrode 1644. The energy and timing of the pulses in waveform 55*a* are selected based on the image data to cause drop break-off to occur either when the drop-to-be is adjacent to charge electrode 44 or when the drop-to-be is at a different distance from nozzle 50 than length BL (FIG. 2). Only a single charge electrode 1644 is used in this example; electrode 1644A is not used.

Referring back to FIG. 19, in an AC-driven individual-electrode configuration, drops are formed separated in time by the fundamental period (on average). Drop formation waveform 55*a* is image-independent and provides a substantially constant energy to the jet to cause equally-spaced break-off of drops. All drops are also substantially the same size. All of the drops are caused to break off adjacent to electrode 44 at break-off location 232. Charging waveform 97 from source 51 is image-dependent, and has two states: a high-charge voltage state and a low-charge voltage state. Each electrode 44 is held in a particular one of the voltage states during the period in which a single drop 35, 36 breaks off jet 43. Drop break-off can be synchronized with electrode waveform 97 by adding a constant phase delay between the drop formation waveform source 55 and charge electrode 44 source so that drops 35, 36 break off during the proper charge electrode waveform 97 voltage state.

In an example, a 2 pL drop can be produced from an 8 micron orifice operating at 500 kHz and 20 m/s drop velocity (the size of an inkjet drop is determined by nozzle diameter, drop formation fundamental frequency and drop velocity, which is closely related to manifold pressure). The diameter of such a drop can be 15.6 μm.

An experiment was performed to test transport of charge using drops. Charged drops were jetted into a Faraday cage to measure the charge on them. In one tested configuration, 20 μm-diameter drops were produced at 600×600 dpi. The resulting charge density on the tested paper was 350 $\mu C/m^2$. In another test, the charge density on the paper was 252 $\mu C/m^2$. Charge density can be increased by increasing the drop diameter or dpi.

The invention is inclusive of combinations of the embodiments or aspects described herein. References to "a particular aspect" and the like refer to features that are present in at least one aspect of the invention. Separate references to "an aspect" or "particular aspects" or the like do not necessarily refer to the same aspect or aspects; however, such aspects are not mutually exclusive, unless so indicated or as are readily apparent to one of skill in the art. The use of singular or plural in referring to the "method" or "methods" and the like is not limiting. The word "or" is used in this disclosure in a non-exclusive sense, unless otherwise explicitly noted.

The invention has been described in detail with particular reference to certain preferred embodiments and aspects thereof, but it will be understood that variations, combinations, and modifications can be effected by a person of ordinary skill in the art within the spirit and scope of the invention.

PARTS LIST

14 deflection mechanism
24 liquid chamber
30 gutter ledge
32, 32B, 32C recording medium
35 uncharged drop
36 charged drop
37 second path
38 first path
42 drop formation device transducer

43 liquid jet
44, 44*a*, 44*b* charge electrode
46 printed drop
47 printhead
50 nozzle
51 charging voltage source
53 deflection electrode
55 drop formation waveform source
55*a* waveform
63 deflection electrode
67 catcher
83 charging device
87 liquid jet central axis
89 drop formation device
97 charge electrode waveform
120 continuous printing system
122 image source
124 image processing unit
126 mechanism control circuits
128 drop forming device
130 printhead
134 recording medium transport system
136 recording medium transport control system
138 micro-controller
140 reservoir
142 catcher
144 recycling unit
146 pressure regulator
147 ink manifold
232 break-off location
400 inkjet printhead
401 inkjet printer system
402 image data source
404 controller
405 image processing unit
406 electrical voltage source
408 first fluid source
409 second fluid source
410 inkjet printhead die
411 substrate
420 first nozzle array
421 nozzle(s)
422 ink delivery pathway (for first nozzle array)
430 second nozzle array
431 nozzle(s)
432 ink delivery pathway (for second nozzle array)
481 droplet(s) (ejected from first nozzle array)
482 droplet(s) (ejected from second nozzle array)
500 printer chassis
502 paper load entry direction
503 print region
504 media advance direction
505 carriage scan direction
506 right side of printer chassis
507 left side of printer chassis
508 front of printer chassis
509 rear of printer chassis
510 hole (for paper advance motor drive gear)
511 feed roller gear
512 feed roller
513 forward rotation direction (of feed roller)
530 maintenance station
540 carriage
550 printhead assembly
562 multi-chamber ink tank
564 single-chamber ink tank
580 carriage motor
582 carriage guide rail
583 encoder fence
584 belt
590 printer electronics board
592 cable connectors
600 printer
621 charger
621*a* voltage source
622 exposure subsystem
623 toning station
623*a* voltage source
625 photoreceptor
625*a* voltage source
632A, 632B recording medium
638 print image
639 fused image
640 supply unit
650 transfer subsystem
660 fuser
662 fusing roller
664 pressure roller
665 fusing nip
668 release fluid application substation
669 output tray
670 finisher
681 transport web
686 cleaning station
691, 692, 693 printing module
694, 695, 696 printing module
699 logic and control unit (LCU)
700 input pixel levels
705 workflow inputs
710 image-processing path
720 output pixel levels
750 screening unit
760 screened pixel levels
770 print engine
810 data processing system
820 peripheral system
830 user interface system
840 data storage system
1010, 1020, 1030 curve
1110 receive image data step
1120 discharge medium step
1125 dry medium step
1130 deposit charged fluid step
1135 provide charged drops step
1140 deposit charged dry ink step
1150 fix dry ink step
1240 eject drops step
1250 charge drops step
1340 break drops off from jet step
1350 charge drops step
1360 deflect drops step
1460 move liquid past electrode step
1470 repeat for all nozzles step
1560 move liquid past electrodes step
1644, 1644A charge electrode
1651, 1651A charging voltage source
1683, 1683A charging device
1760 move liquid past electrode step
1770 repeat for all nozzles step
1840 break drops off from jets step
1850 charge drops step
1860 deflect drops step

2010 receive image data step
2015 receive and compute image data step
2020 discharge medium step
2025 dry medium step
2030 deposit first-sign charged fluid step
2031 apply discrete drops step
2033 deposit second-sign charged fluid step
2035*a* provide charged drops step
2035*b* provide charged drops step
2040 deposit charged dry ink step
2050 fix dry ink step
2140 break drops off from jet step
2150 charge drops for selective deposition step
2160 deflect drops step
2170 charge drops for non-selective deposition step
2180 deposit all drops step
2220 intermediate member
2225 drop retention layer
2228 charged-fluid drop
2229 evaporating charged-fluid drop
2230 printhead
2238 dry ink side
2250 development station
2251 toning member
2252 supply
2253 voltage source
2254 area electrode
2255 voltage source
2258 dry ink particle
2260 fixing device
2262 fixing member
2263 pressure member
2270 transfer station
2271 bias transfer backup roller
2273 bias source
2281 transport belt
2282 image data
2286 controller
2290 dryer
2295 discharger
2320 intermediate member
2323 conductor
2324 voltage supply
2325 drop-retention layer
2330 printhead
2350 development station
2358 dry-ink particles
2361, 2362, 2363 cell
2364, 2366, 2367 cell
2373, 2374, 2375 charged-fluid island
2381 transport member
2382 image data
2383 backing electrode
2384 voltage supply
2386 controller
2391 dryer
2392 replenisher
2393 container
2394 dryer
BL break-off length
d spacing
X axis
Y axis

The invention claimed is:

1. Apparatus for producing a print on a recording medium, comprising:

a) a printhead configured to provide drops of hydrophilic liquid;

b) an intermediate member having a conductive element and a drop-retention layer disposed over the conductive element, the drop-retention layer configured to receive the drops of hydrophilic liquid, the drop-retention layer being formed from a hydrophobic material having a plurality of cells and including an ion donor disposed in one or more of the cells;

c) a controller configured to receive image data for the print and control the printhead and the intermediate member so that a liquid pattern corresponding to the image data is produced in one or more of the cells of the intermediate member, wherein the ion donor in those cells dissolves in the deposited liquid so that the liquid pattern includes ions having respective signs of charge;

d) a transport member configured to bring the recording medium into contact with the liquid pattern on the intermediate member;

e) a backing electrode arranged opposite the positioned recording medium from the intermediate member;

f) a voltage source configured to apply a bias across the recording medium in contact with the liquid pattern using the backing electrode and the conductive element of the intermediate member, so that at least some of the ions of a selected one of the signs of charge move from the liquid pattern to the recording medium and a charge pattern corresponding to the liquid pattern is developed on the recording medium; and g) a development station configured to apply charged dry ink to the recording medium bearing the charge pattern, so that a dry ink image corresponding to the image data is formed on the recording medium.

2. The apparatus according to claim 1, wherein:

the liquid pattern includes ions of two signs of charge, the applied bias moves at least some of the ions of a selected one of the two signs of charge into the recording medium, and the apparatus further includes a replenisher configured to add replenishment ions of the selected one of the two signs of charge to at least some of the cells of the liquid pattern after the charge pattern is formed on the recording medium.

3. The apparatus according to claim 1, wherein a replenisher includes a container of an aqueous solution of replenishment ion donor arranged so that the drop-retention layer passes through the container.

4. The apparatus according to claim 1, further including a dryer configured to remove the liquid pattern from the drop-retention layer after the charge pattern is developed on the recording medium.

5. The apparatus according to claim 4, further including a replenisher configured to deposit replenishment ion donor in the drop-retention layer after the liquid pattern is removed by the dryer.

6. The apparatus according to claim 1, wherein the drop-retention layer is arranged so that the received liquid is in indirect mechanical contact with the conductive element.

7. The apparatus according to claim 1, wherein the drop retention layer is an open-cell foam.

8. The apparatus according to claim 1, wherein the printhead is a drop-on-demand inkjet printhead.

9. The apparatus according to claim 1, wherein the printhead is a continuous inkjet printhead.

10. The apparatus according to claim 1, wherein the dry ink is charged to a sign opposite the selected one of the signs of charge.

11. The apparatus according to claim 1, wherein the ion donor is a salt, acid, or base.

12. The apparatus according to claim 11, wherein the ion donor is selected from the group consisting of NaOH, LiOH, KOH, $H_3PO_4$, $H_2PO_4^-$, and $HPO_4^{2-}$.

* * * * *